US006708967B1

(12) United States Patent
Trovinger et al.

(10) Patent No.: US 6,708,967 B1
(45) Date of Patent: Mar. 23, 2004

(54) METHOD AND APPARATUS FOR MAKING BOOKLETS

(75) Inventors: Steven W Trovinger, Los Altos, CA (US); Ross R Allen, Belmont, CA (US); Erik G Vaaler, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/831,768

(22) PCT Filed: Sep. 29, 1999

(86) PCT No.: PCT/US99/23078

§ 371 (c)(1),
(2), (4) Date: May 14, 2001

(87) PCT Pub. No.: WO00/18583

PCT Pub. Date: Apr. 6, 2000

(51) Int. Cl.[7] ..... B65H 45/22

(52) U.S. Cl. ..... 270/52.26; 270/52.29; 412/16; 83/934; 493/405

(58) Field of Search ..... 270/52.26, 52.29, 270/52.3; 413/16; 83/934; 493/405, 408, 438, 446, 452

(56) References Cited

U.S. PATENT DOCUMENTS

| | | | | | |
|---|---|---|---|---|---|
| 3,897,051 | A | * | 7/1975 | Muller | 270/43 |
| 4,053,150 | A | | 10/1977 | Lane | |
| 4,484,501 | A | | 11/1984 | Ramcke et al. | 83/255 |
| 4,575,296 | A | | 3/1986 | Kockler et al. | 412/6 |
| 4,595,187 | A | * | 6/1986 | Bober | 270/37 |
| 4,640,611 | A | * | 2/1987 | Ohdake et al. | 355/77 |
| 4,795,071 | A | | 1/1989 | Jacobs et al. | 227/7 |
| 4,891,681 | A | * | 1/1990 | Fiske et al. | 399/385 |
| 5,076,556 | A | * | 12/1991 | Mandel | 270/45 |
| 5,087,163 | A | | 2/1992 | Erdbories et al. | |
| 5,108,082 | A | * | 4/1992 | Shea et al. | 270/47 |
| 5,241,474 | A | * | 8/1993 | Marovac | 707/530 |
| 5,346,350 | A | | 9/1994 | Luhman et al. | |
| 5,377,965 | A | * | 1/1995 | Mandel et al. | 270/37 |
| 5,445,592 | A | * | 8/1995 | Richards | 493/444 |
| 5,452,920 | A | | 9/1995 | Parker | |
| 5,456,646 | A | * | 10/1995 | Crowley | 493/187 |
| 5,465,213 | A | | 11/1995 | Ross | |
| 5,632,587 | A | | 5/1997 | Coyette | 412/11 |
| 5,803,891 | A | * | 9/1998 | Haan et al. | 493/442 |
| 5,810,346 | A | * | 9/1998 | Jorg | 270/59 |
| 6,193,458 | B1 | | 2/2001 | Marsh | |
| 6,363,851 | B1 | | 4/2002 | Gerhard et al. | |
| 2002/0140154 | A1 | | 10/2002 | Trovinger | |
| 2002/0146302 | A1 | | 10/2002 | Trovinger | |

OTHER PUBLICATIONS

Investieren Mit Blick Auf Digitale Nischenprodukte (In German) Sep. 17, 1998 p. 45 Deutscher Drucker.

U.S. patent application No. 10/084,460 filed Feb. 28, 2002, entitled "Booklet Maker", Steven W. Trovinger.

U.S. patent application No. 10/231,127 filed Aug. 30, 2002, entitled "Booklet Maker and Method of Manufacturing A Booklet Maker", Steven W. Trovinger.

U.S. patent application No. 09/970,730 filed Oct. 5, 2001, entitled "Sheet Folding Apparatus", Steven W. Trovinger et al.

* cited by examiner

*Primary Examiner*—Patrick Mackey

(57) ABSTRACT

Method and apparatus for assembling sheets of printing media for booklets. In one aspect of the sheets are folded, sheet-by-sheet, and in another aspect the sheets are collected, sheet-by-sheet, and registered on a fold in each sheet. In still another aspect printed sheets are located, sheet-by-sheet, into the apparatus. Each sheet is trimmed to a pre-determined width depending on the position of the sheet in the booklet being assembled. The sheets are thereafter folded, sheet-by-sheet, and collected into a stack. The method and apparatus have particular application in finishing duplex printed sheets of paper into saddle-stitched booklets.

36 Claims, 22 Drawing Sheets

METHOD AND APPARATUS FOR MAKING BOOKLETS

TECHNICAL FIELD

The present invention generally relates to finishing printed sheets of paper and, more particularly, to finishing printed sheets of paper into saddle-stitched booklets.

BACKGROUND ART

Saddle stitched booklets typically contain 100 pages or less; that is, 100 booklet pages produced from 25 sheets of paper, each page printed duplex with two page images on each side of each sheet. The 100 page limitation comes from the sharpness of the fold and the ability of staples to penetrate the stack of sheets.

In the past saddle stitched booklets were produced by processing the entire booklet at once. Referring to FIG. 1, reference numeral 10 generally indicates a stack of duplex printed sheets, arranged in order for binding. The sheets underlay each other and are squared off in registration. One or more staples 12 are driven along the center line 11 of the stack 10 of sheets. After the sheets are stapled, the entire stack is folded along the line formed by the staples. Once folded, the free ends of the sheets form two beveled edges 14, FIG. 2 because the outer sheets must wrap around the inner sheets. The inner sheets stick out and the outer sheets and cover, if any, appear to be shorter. Traditionally, the entire booklet is next trimmed inboard of the edge of the cover because the cover or the outermost sheet is the shortest sheet due to its having the longest wrap length. A heavy duty cutting apparatus 15 performs this trimming operation because the cut must be made through the entire booklet typically 10 to 50 or more sheets. Reference numeral 16 generally indicates a finished, saddle stitched booklet with a finished, flat edge 17.

The prior machines for making saddle stitched booklets typically require long paper paths, powerful motors, heavy and complex cutters, high electrical current, and heavy bracing to withstand high mechanical forces. These prior machines are also bulky, expensive, require a skilled operator, and are therefore ill suited for home and small office use. These machines are typically found only in commercial document production installations.

Thus, it can be seen from the foregoing that prior paper finishing techniques impose size, cost, and power limits upon booklet making devices that hinder the use of these devices in many applications.

Therefore, there has been an unresolved need for a paper finishing apparatus and method that permit the production of booklets using a low-power device that is both inexpensive and compact.

DISCLOSURE OF THE INVENTION

The invention contemplates an apparatus and method for stacking sheets of printing media having folds therein. The apparatus includes a workpiece that stacks the sheets, sheet-by-sheet, and registers the sheets on the folds.

Another aspect of the invention includes an apparatus and method for folding sheets of printing media. The apparatus includes a V-shaped fold roller, an elongate fold blade, means for positioning the sheets, sheet-by-sheet, on the fold blade, and means for translating the fold roller with respect to the fold blade.

Still another aspect of the invention is an apparatus and method for assembling sheets of printing media for booklets.

The apparatus includes a media trimmer that cuts the sheets, sheet-by-sheet, to predetermined widths. The apparatus also has a sheet folder that folds the sheets, sheet-by-sheet, and a stacker that collects the sheets, sheet-by-sheet, in a stack.

Other aspects and advantages of the present invention will become apparent from the following detailed description, taken in conjunction with the accompanying drawings, illustrating by way of example the principles of the invention.

BEST MODE(S) FOR CARRYING OUT THE INVENTION

Figure 1:
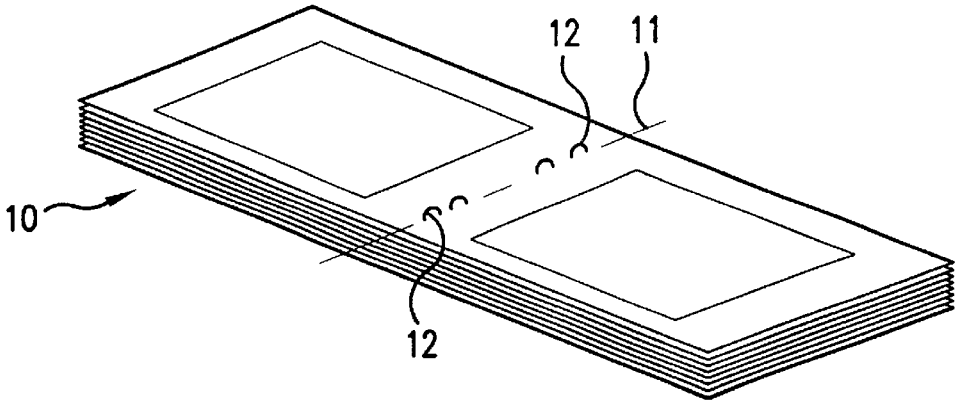
FIG. 1 is an isometric view of stapled stack of printed sheets of paper.
Figure 2:
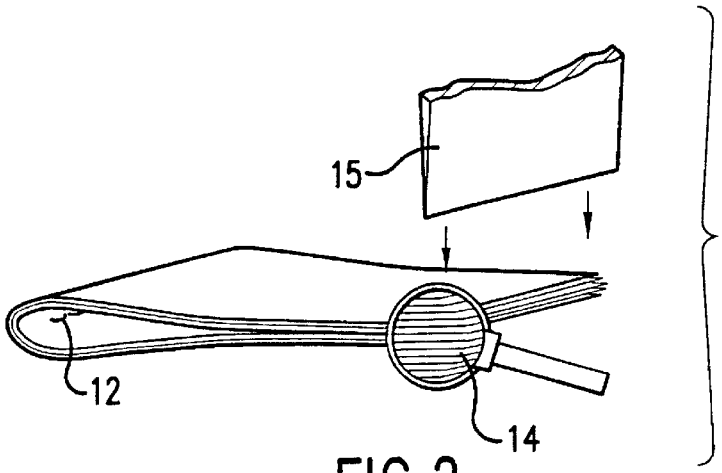
FIG. 2 is an isometric view of the stack of paper of FIG. 1 after folding.
Figure 3:
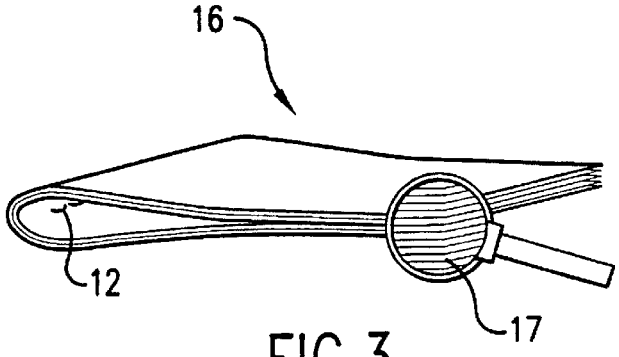
FIG. 3 is an isometric view of the stack of paper of FIG. 1 after folding and cutting.

In the following detailed description and in the several figures of the drawings, like elements are identified with like reference numerals.

Overview

A low cost, low power method and compact apparatus for finishing printed sheets into booklets is described. Novel mechanical operations permit the manufacture of a very low-cost, off-line booklet maker for use with desktop laser and inkjet printers. The technology is scaleable to in-line booklet manufacture with high speed printers and off-set presses.

A unique feature of the present invention is that most of the finishing operations are performed on a sheet-by-sheet basis using precision paper positioning. To form a finished saddle-stitched booklet, each sheet is cut to a width determined by its sequence in the booklet and its thickness. The sheets are then folded, stacked, and stapled. The sheet-wise method allows finishing operations to be done with relatively inexpensive mechanical elements and low actuation forces compared to prior methods.

This booklet maker eliminates the cost and bulk of finishing operations while allowing more operations to be done in a compact, low-cost machine. The use of sheet-wise operations reduces the power and bulk requirements of the finisher, allowing operations to be controlled with low-cost DC motors, solenoids, and stepping motors. The booklet maker described herein concentrates finishing operations into a single module or modules suitable for off-line and in-line processing. Finishing operations such as trim, score/fold, punch, stack, and staple can be modularized to allow custom functionality.

Figure 6:
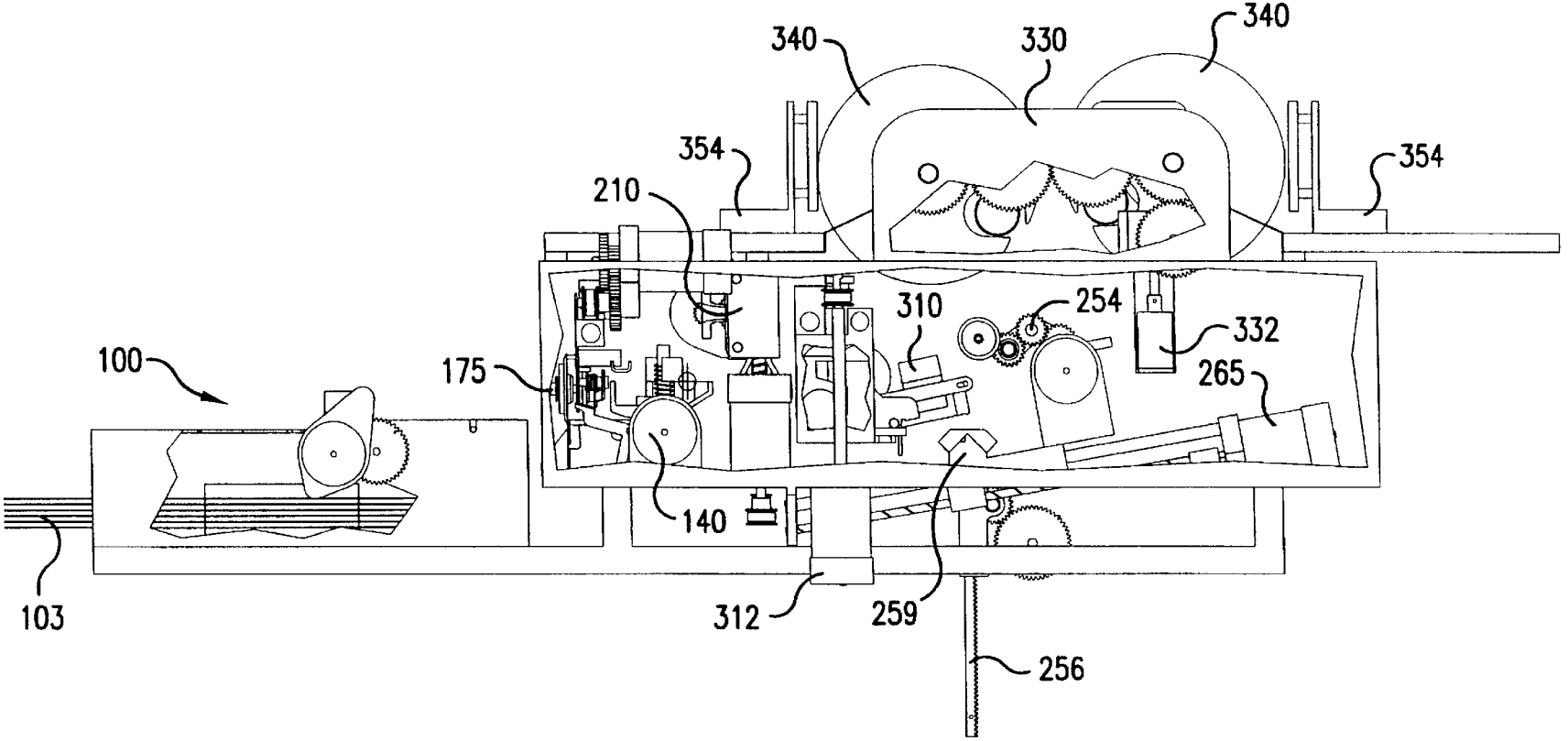
FIG. 6 is a side elevation view of the apparatus of FIG. 4, partially cut away.
Figure 7:
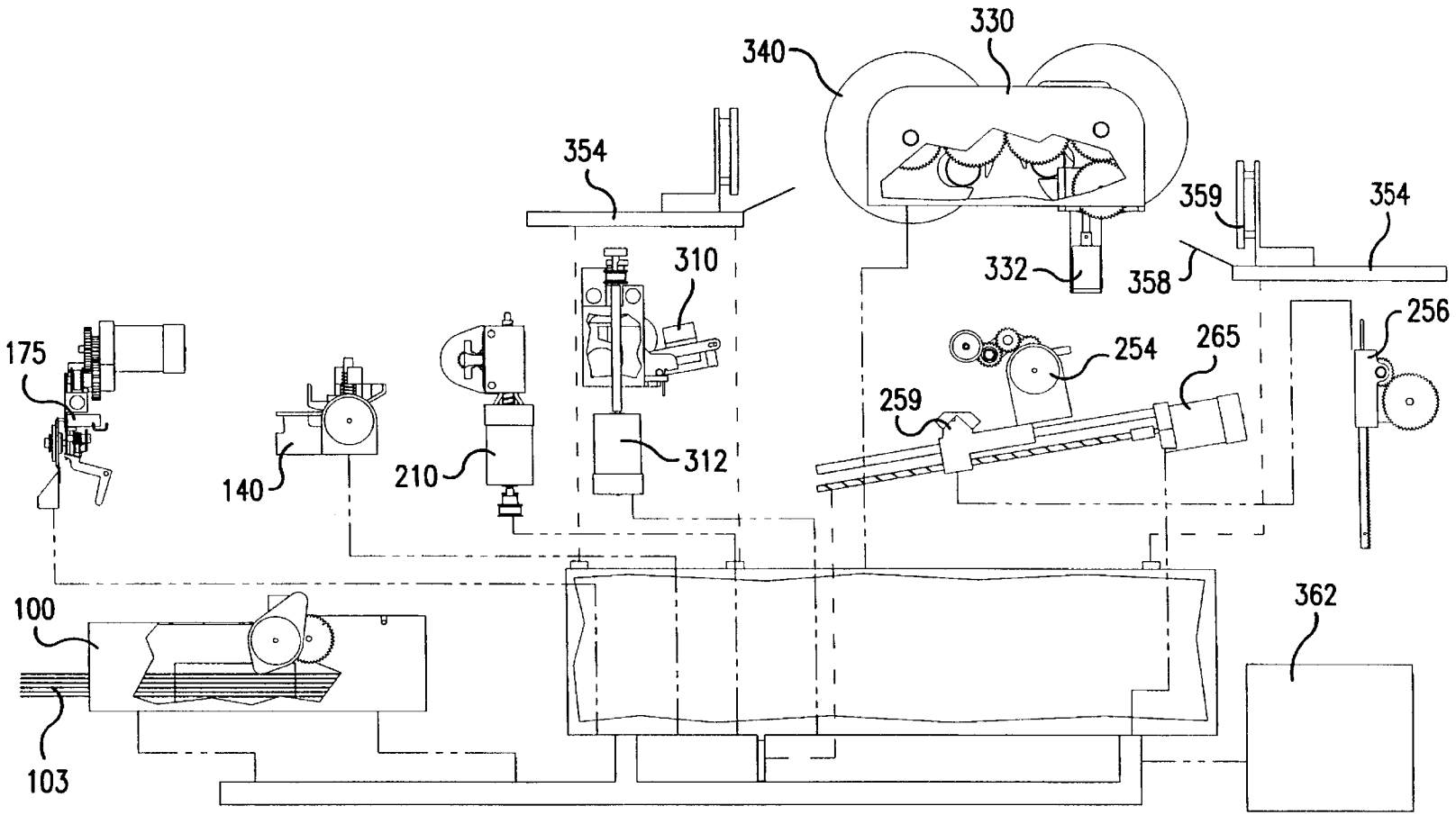
FIG. 7 is an exploded view of the apparatus of FIG. 6.

FIGS. 6 and 7 provide the best overview of the saddle stitched booklet maker. With an automatic sheet feeder 100, the machine shown represents an off-line booklet maker. An in-line version would take printed sheets from the output paper path of a printer. A stack 103 of duplex printed sheets is placed in an automatic sheet feeder 100. The sheet feeder loads the sheets, sheet-by-sheet, into a paper drive assembly 140 that measures the width of each sheet. A cutter assembly 175 trims each sheet to a pre-determined width according to an algorithm. The paper drive assembly 140 next positions each sheet in a fold mechanism 210 that folds the sheets, sheet-by-sheet, along the center line of each sheet. The folded sheet is removed from the fold mechanism 210 by a booklet collection assembly 250 that stacks the sheets in registration on a inverted V-shaped workpiece 259. The stack of sheets is thereafter stapled with a stapler 310 and then ejected by an ejection finger assembly 256 into a booklet unloader 330. The booklet unloader deposits the assembled saddle stitched booklets in the output trays 354.

The Automatic Sheet Feeder

Figure 8:
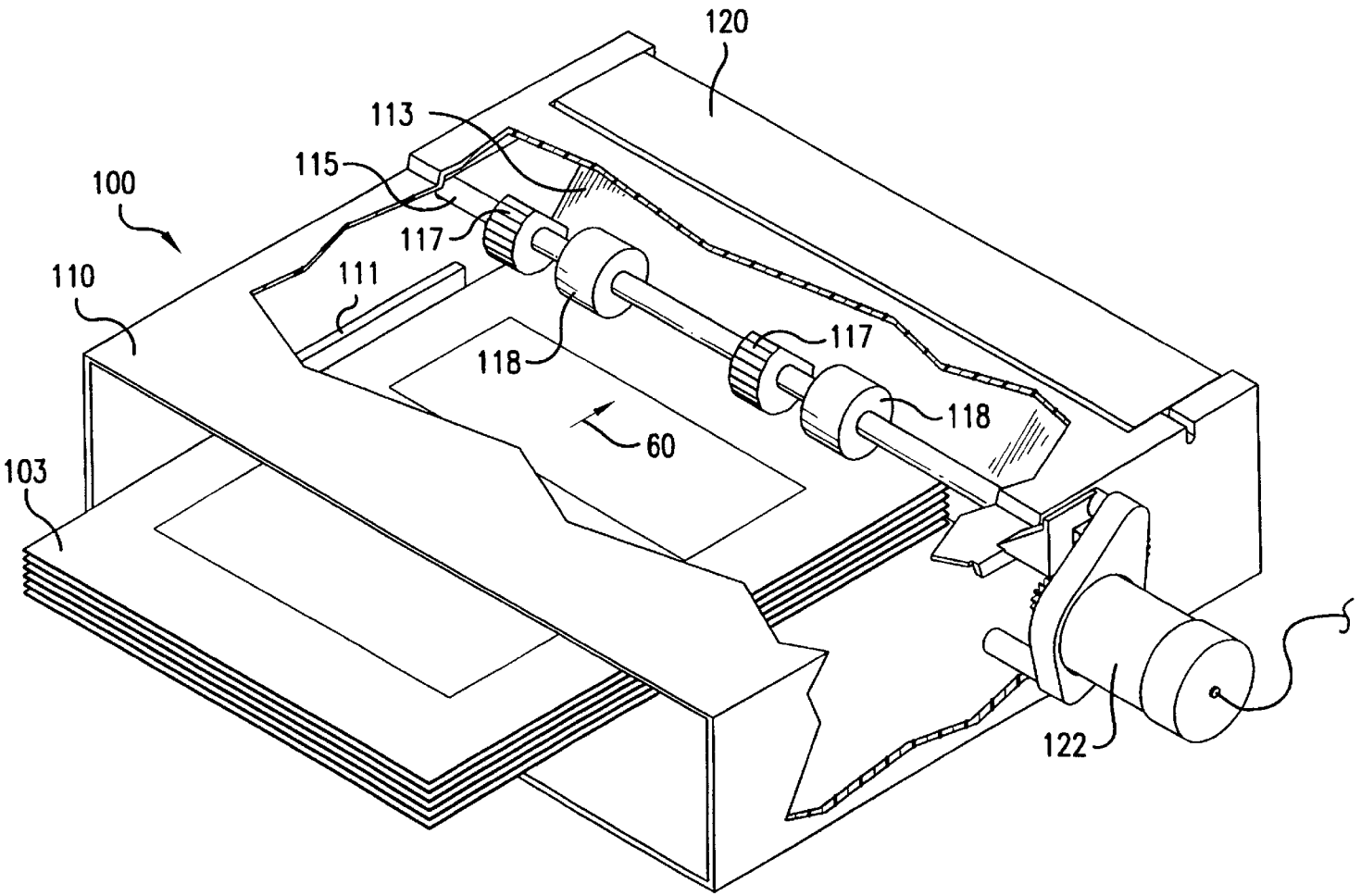
FIG. 8 is an isometric view of the automatic sheet feeder of FIG. 4, partially cut away.

Reference numeral 100, FIG. 8, generally indicates an automatic sheet feeder for the booklet maker. In general, the sheet feeder 100 separates the stack of printed media into individual sheets and, on command, feeds the sheets one-by-one into the sheet-processing paper path 60 of the booklet maker. In particular, the sheet feeder 100 receives a stack 103 of printed media that can be or include paper, card stock, cover material, or transparencies. The sheets in the stack have already been duplex printed as required, paginated, and positioned in sequence for saddle stitching. The sheets are also evenly registered, one directly beneath the other, in the sheet feeder. The stack 103 can come either from various printers physically remote from the sheet feeder, operating off-line, or from a directly attached printer, in-line. The printers that produce suitable printed sheets are laser printers, inkjet printers, off-set printers, and could include other conventional or digital presses or photocopyers.

The stack 103, FIG. 8 of paper is received in an automatic sheet feeder container 110. The container may be fabricated from sheet metal and injected molded plastic parts and holds and mounts all of the components of the sheet feeder. The stack 103 of paper is aligned against its left margin, i.e., left justified; and each sheet is so justified through the booklet maker. Alignment in the sheet feeder is obtained by an edge stop 111 which is fabricated from either plastic or sheet metal. The edge stop squares up the sheets relative to the sheet feeder 100 and, in turn, the rest of the booklet maker. In practice, the more squarely the sheets are aligned, the more reliable the pick and feed of the paper into the booklet maker. There are additional edge stops within the container 110 to adjust for papers of various sizes but for clarity they have been omitted.

The sheet feeder container 110, FIG. 8 houses a stationary, rigid ramp 113 oriented at about 45 degrees with respect to the forward wall of the container. When each sheet of paper is advanced, the face of the ramp directs the sheet upward and out a slot located in the upper forward margin of the container. The sheet is then advanced under a cutter bail 193, FIG. 11 and not shown in FIG. 8.

The sheet feeder container 110, FIG. 8 also contains a pick tire shaft 115. The pick tire shaft is fabricated from either metal or plastic, is non-deformable, and rotates about its longitudinal axis. The shaft is mounted for rotation by journals and bushings, not shown, located in the side walls of the container 110. Further, rigidly mounted on the pick tire shaft 115 are two pick tires 117. Each pick tire is fabricated from an elastomeric material, has a D-shape in cross section, and does not rotate relative to the pick tire shaft 115. The flat cylindrical surface of the pick tire normally rests parallel to, but not contacting, the upper surface of the top sheet of paper. The pick tire shaft and the radius of the pick tire at the flat surface are dimensioned with sufficient clearance so that the tire does not engage the sheet. When picking is performed, the shaft 115 is rotated, the pick tire 117 in turn rotates, and the circular cylindrical surface of the pick wheel frictionally engages the sheet. The leading edge of the sheet is so driven forward, engages the ramp 113, and is thereby directed out of the sheet feeder 100.

Mounted on the pick tire shaft 115, FIG. 8 are two idler wheels 118. Each idler wheel is fabricated from rigid plastic, is mounted for free rotation about the pick tire shaft, has a diameter that is slightly larger than the diameter of the pick tires 117, and keeps the stack 103 of sheets in place within the sheet feeder container 110. The stack 103 is continuously pressed upward against the idler wheels by a plurality of springs, not shown, located between the bottom of the stack 103 and the bottom wall of the container 110. These springs by their upward pressure generate the friction between the pick tires 117 and the top sheet in the stack 103 when picking occurs.

Located in the top wall of the sheet feeder container 110, FIG. 8 is a diverter 120. The diverter is a hinged flap that rotates upward when a sheet is directed against it by the upwardly inclined ramp 113. The diverter turns the upwardly directed sheet coming from the ramp over horizontally and into the cutter bale 193, FIG. 11 and not shown in FIG. 8.

The pick tire shaft 115, FIG. 8, is rotated by a sheet feed drive motor 122 mounted on the side wall of the sheet feeder container 110. The drive motor is a DC servo motor connected to the pick tire shaft 115 by a gear train. The motor is actuated by electrical signals from a motor controller 362, FIG. 7 and described in detail below. The rotation of the pick tire shaft is measured by shaft turn counts returned to the motor controller 362 from a shaft encoder connected to the sheet feed drive motor. Mounted on the pick tire shaft 115 is a sensor that determines the rotational position of the flat surfaces on the pick tires 117. This signals the motor controller that the pick tires have released their friction engagement of the top sheet.

In operation, the automatic sheet feeder 100, FIG. 8, normally sits with a stack 103 of sheets in the sheet feed container 110. The stack is upwardly pressed against the idler wheels 118 by a plurality of springs, not shown, located between the bottom of the stack and the bottom wall of the container 110. The flat surfaces of the pick tires 117 abut the upper most sheet, but the pick tires do not frictionally engage the sheet.

Motion is initiated by a drive signal from the motor controller 362, not shown in FIG. 8, to the drive motor 122. The pick tire shaft 115 is rotated by the motor, and the pick tires 117 commence to frictionally engage the uppermost sheet. The sheet is moved forward by the rotation of the pick tires, contacts the upwardly inclined ramp 113, is directed upward by the ramp, opens the diverter 120, and passes onto the main paper drive as described below. To move the sheet sufficiently forward to be successfully handed off to the main paper drive, the pick tires complete multiple rotations. The pick tires continue to engage the sheet until the motor controller 362 determines that the sheet has arrived at the main paper drive and that the main paper drive has successfully captured the sheet. When these two conditions are met, the pick tires rotate so that their flat surfaces once again abut the uppermost sheet in the stack 103, formerly the one below the sheet now in the main paper drive, thereby releasing their frictional engagement of that sheet.

The sheet feeder accommodates sheets of differing materials, weights, widths, lengths, and shapes. The only requirement is that the leading edge of each sheet be engaged by the main printer drive as described below. Skewing of sheets is minimized by positioning the pick tires for uniform engagement.

It should be appreciated that the automatic sheet feeder 100, FIG. 8 can be eliminated all together from the booklet maker. In one embodiment, sheets are fed manually one-by-one into the main paper drive by an operator. In another embodiment, the booklet maker is physically coupled to a printer, "in-line", so that the printer performs the sheet-by-sheet feeding directly into the main paper drive from the printer's output paper path. It should be noted that means to temporarily store or "buffer" sheets may be required if a process step in the booklet maker, for example stapling the booklet, takes longer than the time between successive sheets.

If a printer located remote from the booklet maker produces the printed sheets, the sheets may be printed to a removable tray that is received in the automatic sheet feeder 110. Such an output paper tray keeps the stack in order during transfer of the stack, assures the proper orientation of the sheets into the booklet maker, and the sheet feeder operates in the same manner as described above.

The automatic sheet feeder is also contemplated to include center justified alignment using edge stops that center the sheets about their center lines.

The Paper Drive Assembly

Figure 9:
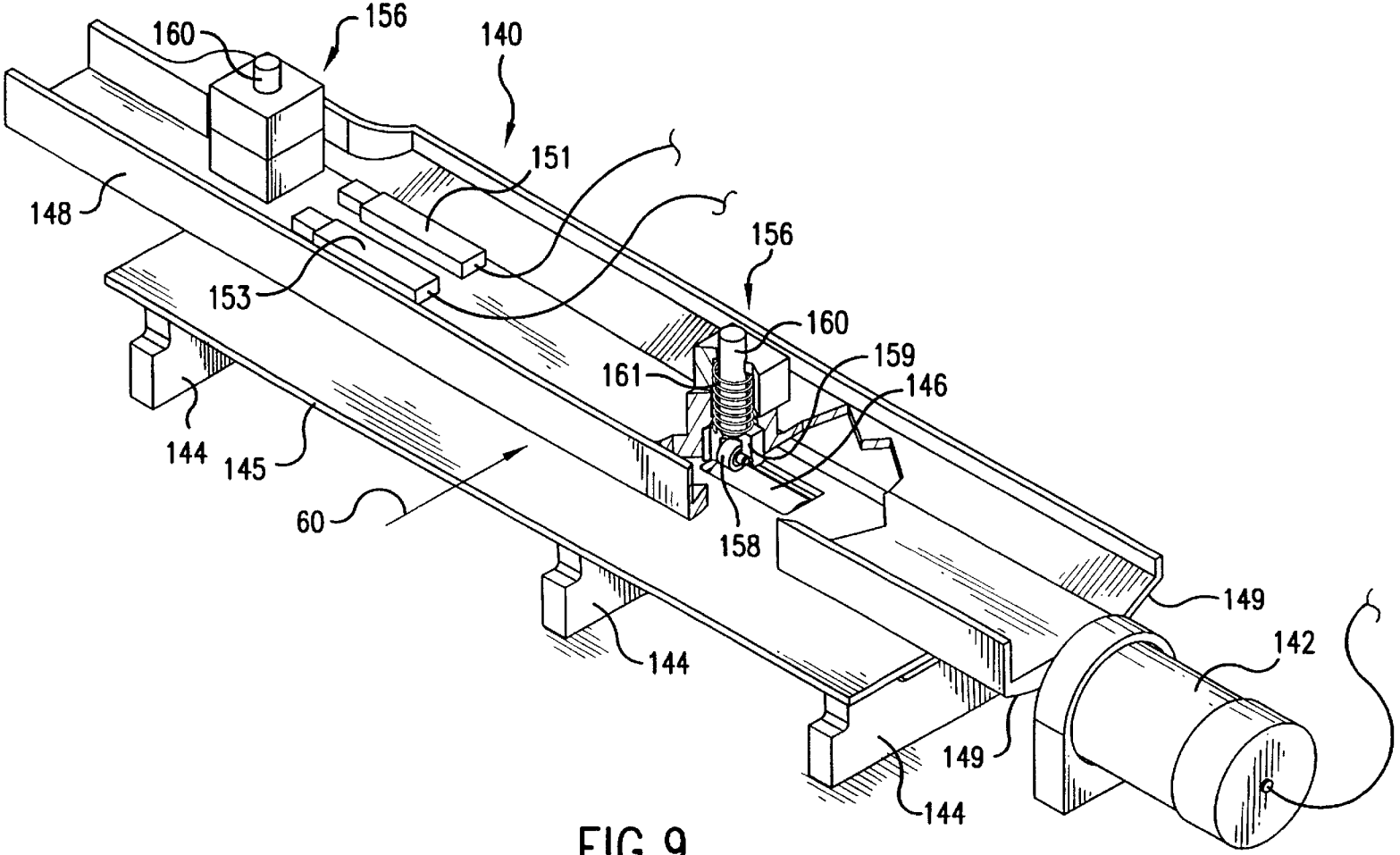
FIG. 9 is an isometric top view of the paper drive assembly of FIG. 7, partially cut away.
Figure 10:
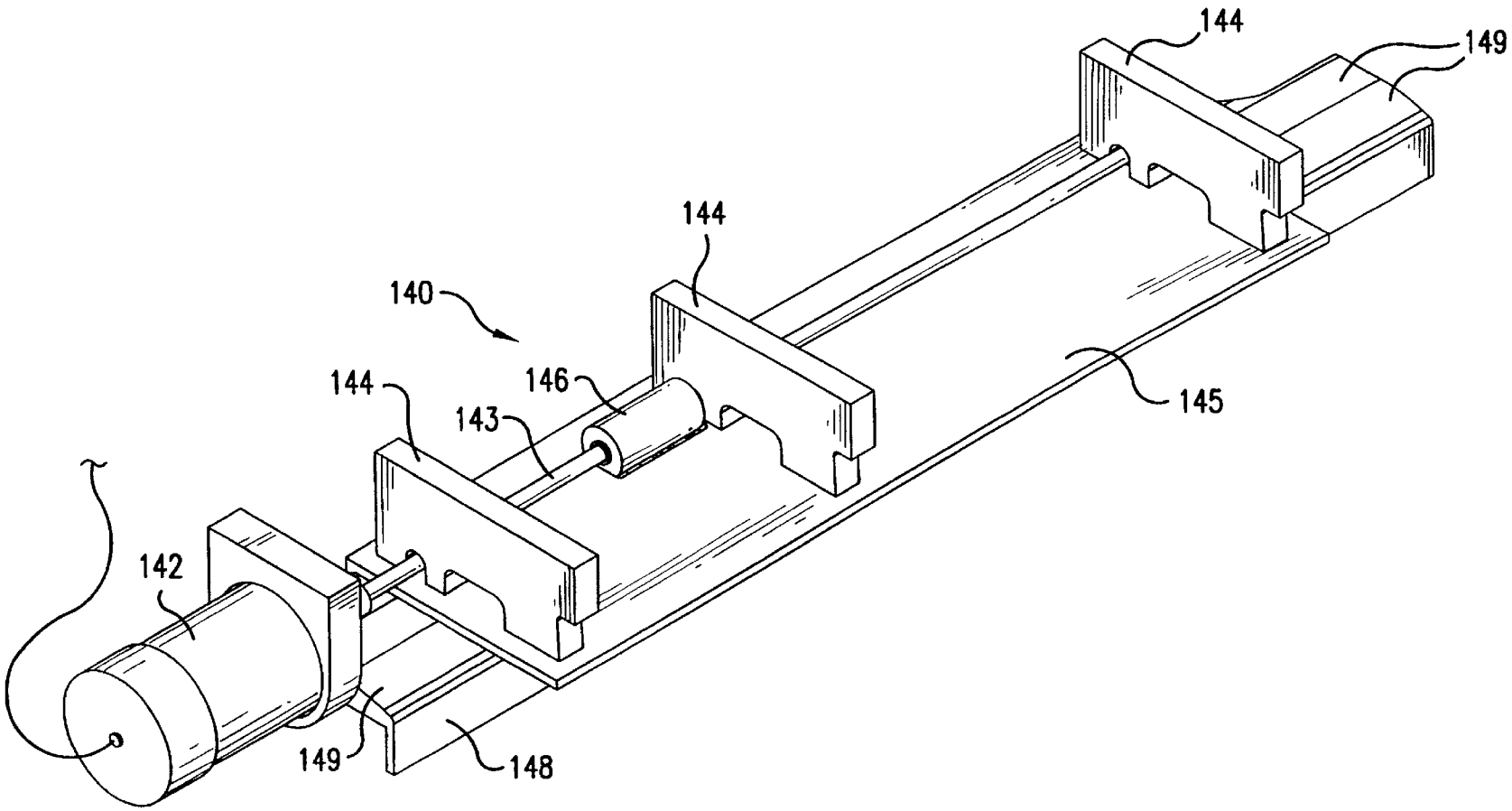
FIG. 10 is an isometric bottom view of the paper drive assembly of FIG. 7.

Reference numeral 140, FIGS. 9 and 10, generally indicates a paper drive assembly that moves the sheets forward and backward in the paper path direction 60 with precision within the booklet maker so that the sheets may be measured for length, cut, and folded. The paper drive assembly moves the sheets one at a time and is driven by a drive motor 142. The drive motor is a DC servo motor that is actuated by the motor controller 362, FIG. 7 and not shown in FIGS. 9 and 10. The drive motor is rigidly mounted on the frame and has a shaft encoder that measures the rotation of the motor when it is actuated. The drive motor directly drives a drive shaft 143, FIG. 10, on which a grit wheel 146 is rigidly mounted. The grit wheel is a solid, circular metal cylinder on which grit is adhesively bonded so that when sheets are advanced either forward or backward, there is no slippage of the sheet with respect to the circumference of the grit wheel. The grit wheel 146 is rotated by the drive motor 142 via the drive shaft 143. An elastomeric pressure roller could also be used instead of the grit wheel.

Within the paper drive assembly 140, FIGS. 9 and 10, the sheet is supported horizontally by a paper plane 145 and the paper plane is rigidly supported with respect to the frame by three support pieces 144. The paper plane is the main horizontal surface across which the sheets are moved and serves as a reference surface for the other components of the booklet maker. The surface of the paper plane has been anodized black so that the leading and trailing edges of the sheets can be detected by optical sensors 151 and 153.

Located above the paper plane 145 and rigidly mounted to the fame of the booklet maker is a page guide 148, FIGS. 9 and 10. The page guide has two ramp faces 149 that each act as funnels and direct the edges of the sheet into the nip of the grit wheel 146 and a pinch wheel 158. The ramp faces 149 converge toward the paper plane 145 at the nip of the wheels so that if the sheet has any curl, the sheet will not jam and will be translated smoothly into the pinch point.

Reference numeral 156, FIG. 9, generally indicates two pinch wheel assemblies each of which press a pinch wheel 158 downward against the grit wheel 146. Each pinch wheel assembly includes a pinch wheel holder 159 that captures the pinch wheel 158, permits free rotation of the pinch wheel about an axis parallel with the axis of rotation of the grit wheel 146, and maintains parallel the axes of rotation of the grit wheel and the pinch wheel. Vertical motion of the pinch wheel is obtained by a vertical shaft 160 that is vertically mounted in the pinch wheel assembly 156. The pinch wheel is pressed against the grit wheel by a coil spring 161 located around the vertical shaft. When a sheet is introduced into the nip between the grit wheel 146 and the pinch wheel 158, the spring insures that the sheet is engaged by the grit wheel and no slippage occurs.

Mounted on the page guide 148, FIGS. 9 and 10 are two sensors 151 and 153 used to detect the leading and trailing edge of the sheet. Each sensor is a reflective sensor and employs an infrared emitter and detector. The anodized black paper plane 145 scatters the infrared light and normally the beam of light from the emitter is not reflected back to its detector. If a sheet is present, however, the sheet reflects the emitted beam back to the detector and a signal is sent from the sensor to the motor controller 362, FIG. 7 and not shown in FIGS. 9 and 10. The sensor 153 is located closer to the sheet feeder 100, FIG. 7, is the first sensor encountered by a sheet along the paper path 60 through the booklet maker, and measures the trailing edge of the sheet. The sensor 151 is located further along the paper path 60 relative to the sensor 153 and measures the leading edge of the sheet. The positions of the two sheet edge sensors 151 and 153, FIG. 9 are known with respect to the line connecting the two pinch points, i.e., the nips of the grit wheels 146 and the pinch wheels 158. Thus, the motor controller 362 of the booklet maker measures the length of each sheet from the leading edge signal received from sensor 151 and its position relative to the pinch point, the number of encoder counts received from the drive motor 142, and the trailing edge signal from sensor 153 and its position relative to the pinch point. The length of each sheet is precisely measured, so that each sheet can be precisely cut, folded, and stapled.

In operation, the sheet is fed into the paper drive assembly 140, FIG. 9 by either the automatic sheet feeder 100, FIG.

7 or any other sheet feeding apparatus, as described previously. The DC drive motor 142 of the paper drive assembly does not turn during paper picking. The arrival of the sheet into the paper drive assembly 140 is signaled by its leading edge being detected by the sensor 153. The sheet is fed forward by the sheet feeder down the paper path 60 until its leading edge contacts the nips of the grit wheels 146 and the pinch wheels 158.

The sheet is aligned longitudinally, i.e., in the direction of the paper path 60, with a buckle de-skew. In particular, the sheet is driven against the two pinch points of the two sets of wheels, and if the sheet is out of alignment, a buckle in the sheet is formed. The buckle acts as a spring and the paper then self-registers against the two pinch points, being driven forward by the sheet feeder 100, FIG. 7.

Next, the paper drive motor 142, FIG. 9 rotates and the sheet is drawn into the paper drive assembly 140, FIG. 9. The sheet, in effect, is handed off from the automatic sheet feeder 100, FIG. 7, into the paper drive assembly. At this point the sheet is firmly clamped between the grit wheels 146 and pinch wheels 158 so that it may be positioned precisely for subsequent operations.

The booklet maker next measures the length of each sheet. First, the location of the leading edge of the sheet is signaled to the motor controller 362 by the sensor 151. Then, the number of encoder counts from the paper drive motor 142 is measured, indicating to the motor controller how far the sheet has been translated by the drive motor. Then, the trailing edge of the sheet is detected by the sensor 153. With the knowledge of the precise locations of the sensors and the number of encoder counts, the motor controller 362 then calculates the actual length of the sheet.

As described in detail below, the motor controller 362, FIG. 7 next calculates the required length of the sheet based on the pagewise position of the sheet in the booklet, and often the sheet thickness. Once the required length of the sheet and the amount of sheet to be cut off are computed, the sheet is translated backwards along the paper path by the paper drive assembly into a cutter assembly 175, FIG. 11. The paper is positioned in the cutter, held in place, and cut. Thereafter, the paper drive moves the sheet forward along the paper path 60 and precisely positions the sheet in the fold mechanism locating the fold point. The sheet is folded and conveyed to the booklet collection system as described in detail below.

The edge sensors 151, 153, FIG. 9 can also be used to read bar code indicia that are printed on a job ticket that is passed through the booklet maker in front of or before the duplex printed sheets that will processed into the booklet. The job ticket provides job processing instructions in machine readable form to the booklet maker. These can include the number of sheets, the thickness of the sheets or individual sheets, the number and position of staples, the final finished size of the booklet, and other information. The job ticket can originate from any source including the printer that printed the sheets.

The Cutter Assembly

Figure 11:
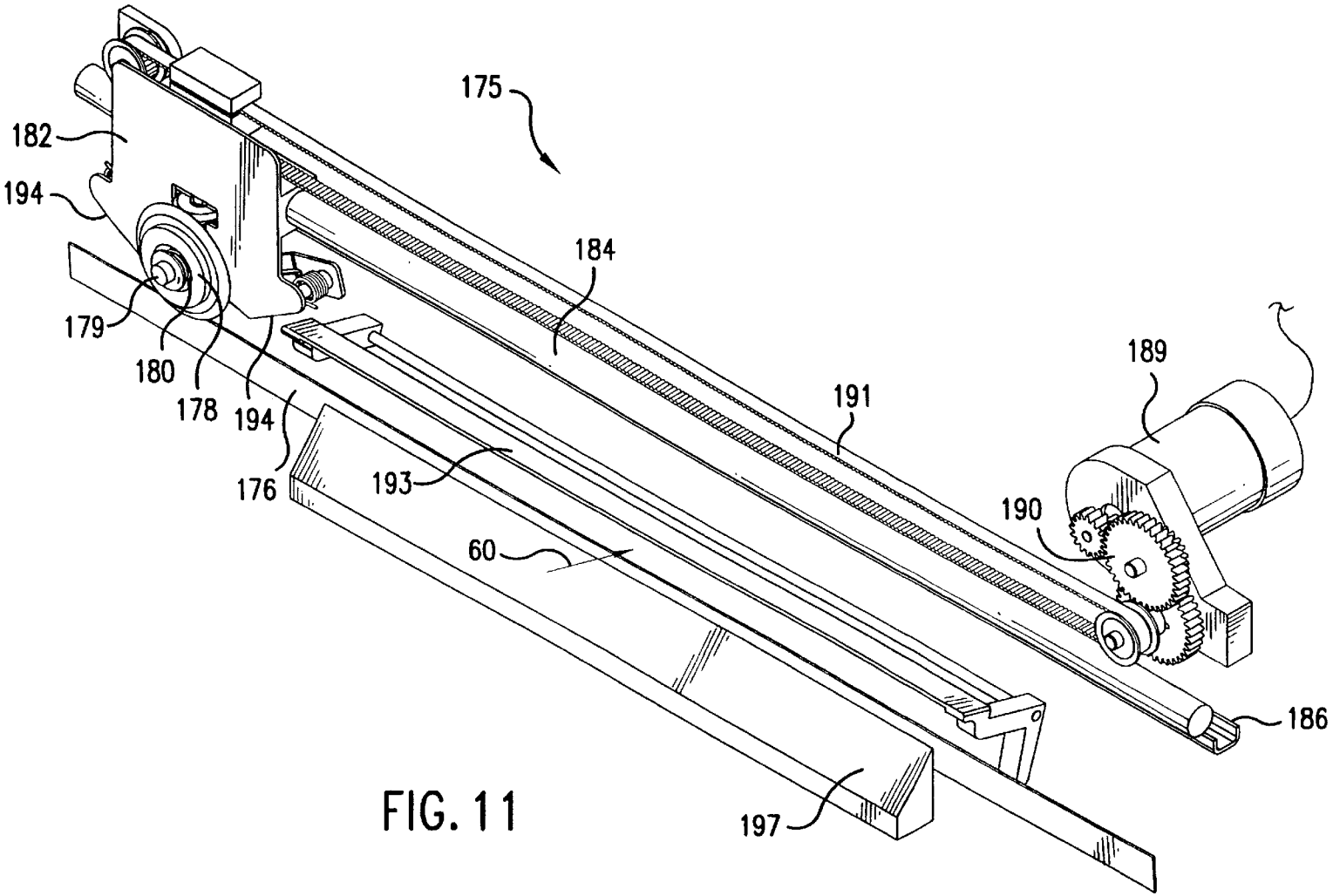
FIG. 11 is an isometric view of the cutter assembly of FIG. 4 in the direction of the paper path, partially cut away.

Reference numeral 175, FIG. 11 generally indicates a cutter assembly that trims each sheet to a predetermined length in the booklet maker. The cutter assembly transversely moves across the paper path while clamping the sheet down, thereby cleanly cutting off a strip of the sheet in one pass. To increase throughput, the cutter assembly can operate bi-directionally: it can cut in the reverse direction between subsequent sheets. The amount trimed is calculated by the motor controller 362 and is physically determined by the paper drive assembly 140, FIG. 9 that precisely positions the sheet with respect to the cutter assembly 175.

Figure 12:
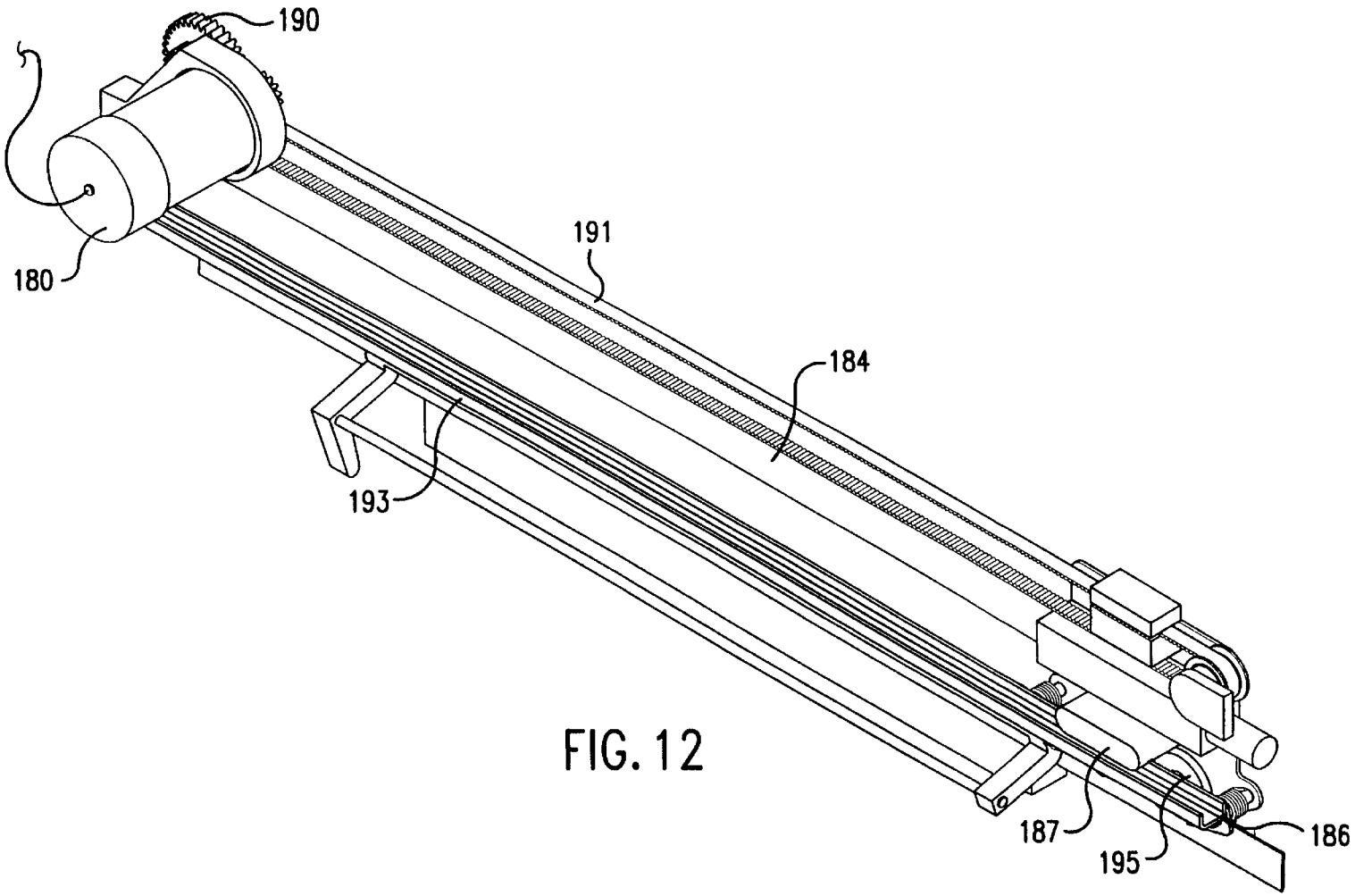
FIG. 12 is an isometric view of the reverse side of the cutter assembly of FIG. 11, partially cut away.

The cutter assembly 175, FIGS. 11 and 12, includes a linear blade 176 fabricated from hardened steel. The linear blade is a flat straight edge that is parallel with the line of the pinch points of the grit wheels 146 and the pinch wheels 158 of the paper drive assembly 140, FIGS. 9 and 10 and that is also perpendicular to the paper path. The linear blade has a sharp edge like the tine of a pair of scissors.

The cutter assembly 175, FIGS. 11 and 12, also includes a rotary blade 178 fabricated from hardened steel. The rotary blade is round, self-sharpening, and tapered at its periphery. The rotary blade rotates freely about an axle 179. A spring 180 presses the rotary blade against the upper edge of the linear blade 176 and the axle is positioned so that the rotary blade contacts the linear blade at only two points. The rotary blade and the linear blade do not make face-to-face contact.

Sheets are cut by the cutter assembly 175, FIG. 11, in much the same manner as with a scissors. The cutting is performed by essentially crushing the paper between the rotary blade 178 and the linear blade 176. The rotary blade and the linear blade have an angle of attack of about 15 degrees with the horizontal. The angle of attack is determined by the diameter of the rotary blade and its vertical position with respect to the linear blade. The angle of attack is selected so that the sheets are not forced out of the interface between the two blades and so that the sheets are cut with a minimum force.

The rotary blade 182, FIG. 11 is supported by a blade holder 182 that permits the rotary blade to translate back and forth across the paper path 60 in a cutting motion along the linear blade 176. The blade holder retains the rotary blade 178 rigidly with respect to the linear blade 176 so that the rotary blade does not move vertically or longitudinally along the paper path. The transverse motion of the blade holder 182 across the paper path 60 is controlled by a main slider rod 184. The main slider rod is a non-deformable, large diameter, solid, stationary, elongate cylinder rigidly mounted on the frame of the booklet maker. The main slider rod is received in the blade holder as illustrated in FIG. 11. The blade holder is mounted for some rotational motion about the longitudinal axis of the slider rod so that the spring 180 urges the rotary blade 178 against the linear blade 176 as described above. Excessive rotation of the blade holder 182 about the main slider rod is prevented by a stationary guide channel 186 and a guide block 187, FIG. 12 mounted on the blade holder.

The rotary blade 178, FIG. 11 is driven across the paper path in a cutting motion with respect to the linear blade 176 by a drive motor 189. The drive motor is a DC servo motor 189 controlled by the motor controller 362, FIG. 7. The drive motor translates the rotary blade 178 via a conventional gear train 190 and a drive belt 191 connected to the blade holder 182.

Referring to FIGS. 11 and 12, the sheet is clamped in place during cutting by a cutter bail 193. The cutter bail is a transverse member located perpendicular to the paper path 60 and proximate to and generally overlying the linear blade 176. Normally the cutter bail is spring loaded, upward and open, so that the sheets can pass beneath. When the blade holder 182 is moved transversely across the paper path, the blade holder engages the cutter bail, presses it downward upon the underlying sheet and thereby locks the sheet in place for cutting. The bail constrains the sheet at the point of cutting so that the sheet does not shift or move during the cutting process. In particular, the blade holder 182 has two inclined, opposed ramps 194. Since the blade holder cuts bi-directionally, the inclined ramps are opposed so as to engage the bail when the blade holder is traveling in either transverse direction. The inclined ramp that first engages the bail rotates the bail downward. Thereafter, as the transverse motion of the blade holder continues, the bail is further pressed downward by two bail rollers 195 mounted on the blade holder on either side of the rotary blade 178 and its axle 179, FIG. 11, thereby clamping the sheet in place proximate to the cutting point. One of the bail rollers 195 is illustrated in FIG. 12.

After being cut, the free strip trimmed from the sheet falls downward and is directed away from the cutter assembly 175, FIG. 11, by a vertical ramp 197. Cut strips are collected in a bin that is emptied periodically by an operator.

Sheet Cutting Schedule

Figure 13:
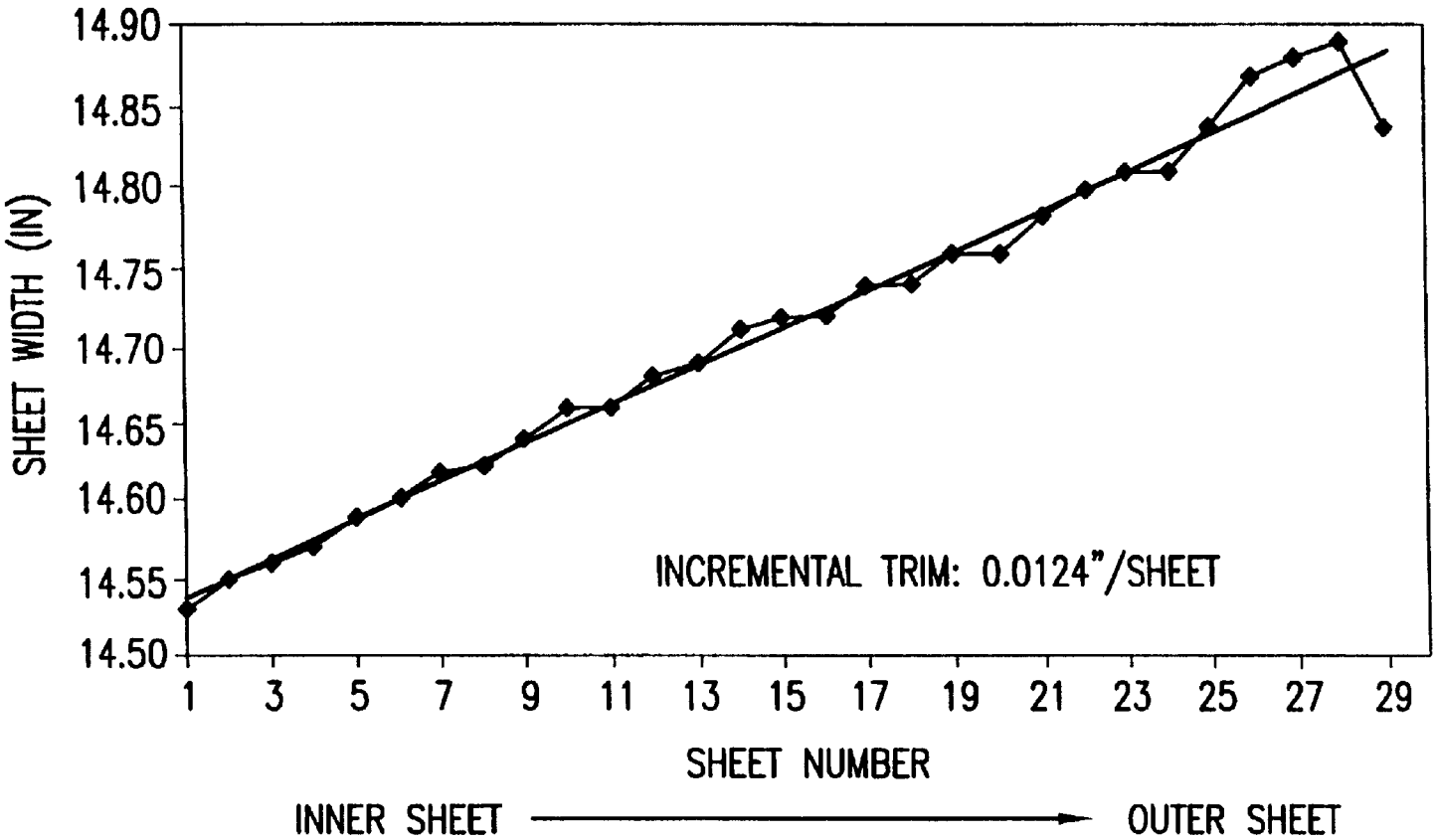
FIG. 13 is a trim schedule for media according to one embodiment of the present invention.

In the booklet maker, each sheet is individually precision-trimmed to a predetermined length depending on the thickness of the paper and the location of the sheet in the booklet; the innermost sheet is the shortest, and the outermost sheet, i.e., the cover, is the longest. Each sheet has a different finished dimension due to the effect of the outer sheets wrapping over the inner ones. In the booklet maker, each sheet is cut to a unique and precise length and the fold line established so that the edge of the assembled booklet is flat as if all sheets had been trimmed together to a final size. This operation, performed a sheet at a time, eliminates the need for a powerful cutting apparatus needed to trim all the pages in the booklet at once. The cutting operation cuts only one edge of the individual sheets to vary the page width there being no need to cut both edges of each sheet. In this manner, the entire booklet need not be cut to produce a flat edge after the sheets are folded and stapled. Individual sheet width is determined by an algorithm and is a function of the page number and thickness of the paper. FIG. 13 illustrates a cutting schedule for sheets of typical 20 pound office paper that are each about 0.00325 inches thick. Each sheet is about 0.0124 inches wider than its immediate predecessor going from the inner-most sheet to the outer-most sheet. This is the manner in which sheets are typically collected on the saddle for stapling to be described later: inner sheet first followed by the body of sheets and finally the cover.

The number of sheets in a booklet and other job and media parameters can be specified electronically, through a network connection, a front panel, or by using a machine-readable job ticket. The paper edge sensors 151 and 153 can be used to read the bar code data on a job ticket to provide instructions to the finisher.

The number of pages in the booklet need not be specified in advance if the booklet is made with the cover as the first sheet and additional sheets follow the cover through the finishing operation. In this case, the cutting schedule can be made a function of page count (and media thickness) until another cover sheet or job separator is encountered.

When the booklet maker trims only the trailing edge of each sheet to a prescribed schedule, the page images on each sheet must be justified with respect to a unique center line (i.e., fold line) for each sheet. This is accomplished by so-called page imposition software in the host application or printer driver (not shown). For example, if each sheet is trimmed 0.0124 inches wider than its immediate predecessor going from the inner-most sheet to the outer-most sheet, the center line will move 0.0062 inches away from the untrimmed edge. The printed images must be adjusted accordingly as they are printed. In one embodiment, image offset and page imposition is handled automatically by the printer driver when the booklet making option is selected.

It is possible to measure the thickness of individual sheets as they are presented to the booklet maker and adjust the cutting algorithm accordingly based on the accumulated number of sheets and their thickness. This allows for variation in page thickness within the booklet, such as card stock for different chapters, inserts, centerfolds, etc. Alternatively, a sheet thickness specification may be included as data in an electronic or machine-readable job ticket.

Drills and Punches

After each sheet has been cut to its pre-determined length, the sheet can be drilled or punched for insertion into a three-ring binder, for example. The sheets can also be punched to form semi-circular index tabs or notches similar to those commonly used in dictionaries, for example. This punching and drilling can be done either sheet-by-sheet or after being collected in a stack by the booklet collection assembly 250, FIG. 23. A conventional paper drill or punch may be used. The drill or punch is positioned and actuated in the same manner as the stapler assembly 310, FIG. 29, described below.

The Fold Mechanism

Figure 14:
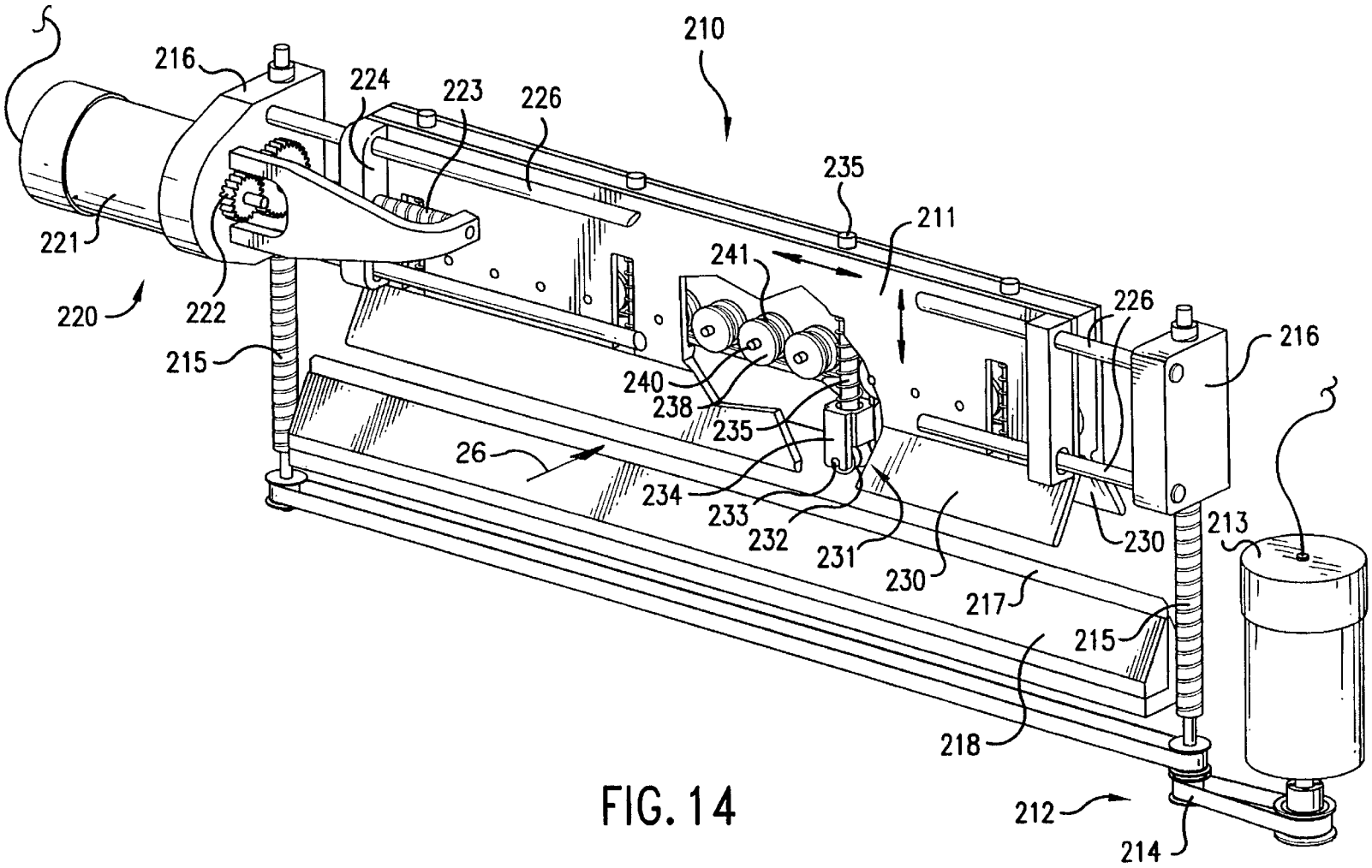
FIG. 14 is an isometric top view of the fold mechanism of FIG. 7, partially cut away.
Figure 15:
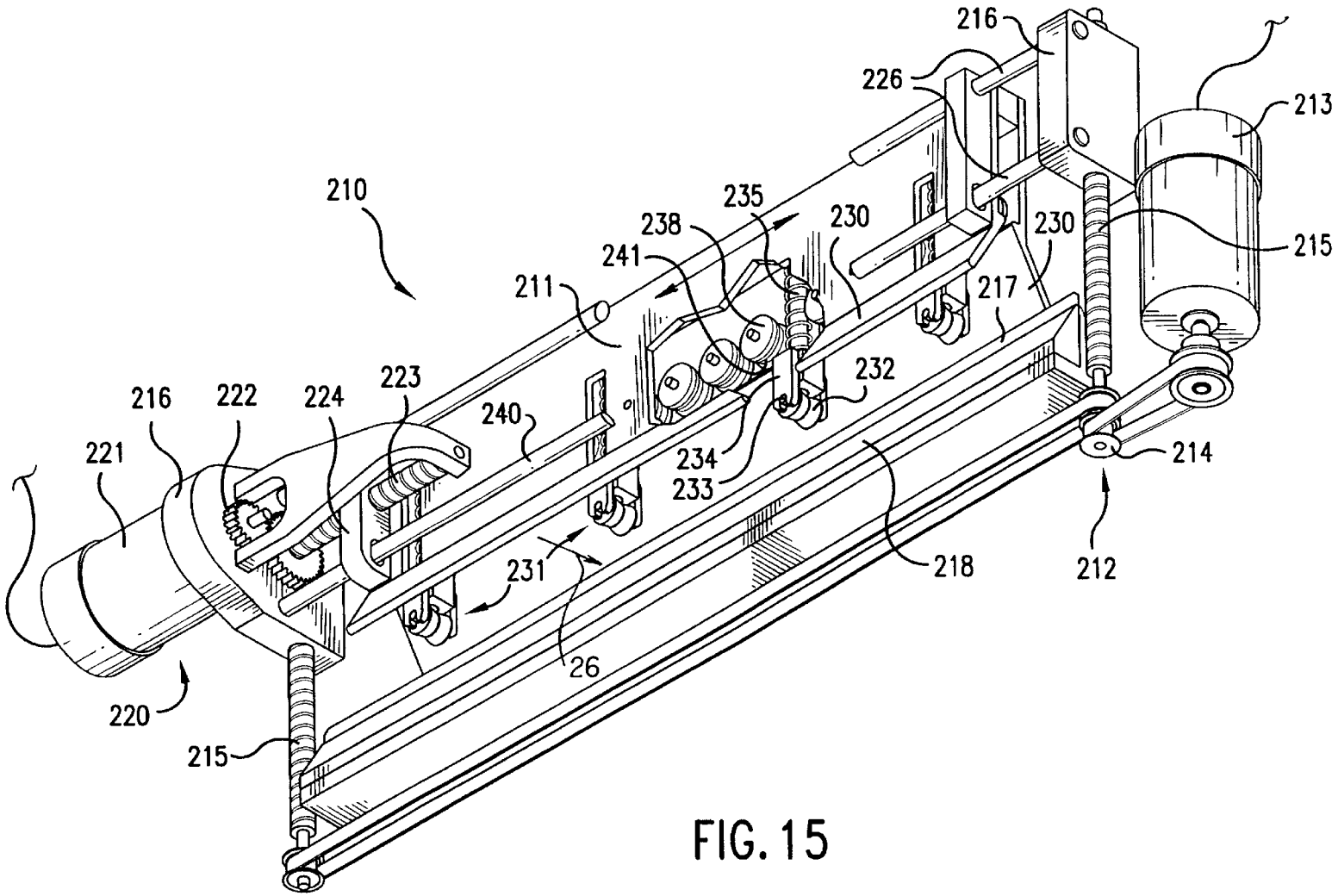
FIG. 15 is an isometric bottom view of the fold mechanism of FIG. 7, partially cut away.

Referring to FIGS. 14 and 15, reference numeral 210 generally indicates a fold mechanism that forms a sharp fold in each sheet by forcing the sheet down over a blade with a folder assembly 211 and pressing the fold into place over the blade with the folder assembly. Each sheet is precisely positioned over the blade by the paper drive assembly 140, FIGS. 9 and 10.

Reference numeral 212, FIGS. 14 and 15, generally indicates a vertical drive motor assembly that translates the folder assembly 211 upward and downward with respect to the booklet maker paper path. The vertical drive motor assembly 212 includes a DC servo motor 213 that is actuated by the drive motor controller 362, FIG. 7. The servo motor is rigidly attached to the frame of the booklet maker. The drive motor 213 is connected by a series of drive belts and pulleys 214 to two vertical lead screws 215. These lead screws are captured for rotation at both ends by the frame of the booklet maker and do not translate either vertically or horizontally. Rotation of the lead screws 215 translate two vertical carriages 216 up and down. The vertical motion of the vertical carriages 216, in turn, translates the folder assembly 211 vertically to engage and immobilize the sheet and to form the fold.

The fold mechanism 210, FIGS. 14 and 15, also includes a fold blade 217 and a fold blade holder 218. The fold blade is a thin, elongate, rigid, hardened stainless steel member that defines the shape and position of the fold in each sheet. The fold blade is positioned perpendicular to the paper path 60 and parallel to the line of the pinch points on the paper drive assembly 140, FIGS. 9 and 10. The fold blade holder 218 is a fixture the rigidly mounts the fold blade 217 to the frame of the booklet maker. The folder assembly 211, FIGS. 14 and 15, is moved transversely by a horizontal drive motor assembly 220. The horizontal drive motor assembly moves the folder assembly transversely back and forth to deform the sheet producing a fold at the desired location after the folder assembly 211 has traveled downward and engaged the sheet. The horizontal drive motor assembly includes a DC servo motor 221 mounted on one of the vertical carriages 216. This motor is actuated by the motor controller 362 and is connected by a gear train 222 to a horizontal lead screw 223. Rotation of the horizontal lead screw moves a horizontal carriage 224 transversely across the paper path. The horizontal carriage in turn is rigidly attached to the folder assembly 211. The horizontal motion of the folder assembly 211 caused by the lead screw 223 is guided by two parallel horizontal slider rods 226 which are mounted on the vertical carriages 216 and which thereby support the folder assembly 211.

The folder assembly 211, FIGS. 14 and 15 includes two, opposed, downward and outward opening, fold flaps 230. The fold flaps are winged, elongate structures that have an opening angle that meets or exceeds the angle of the fold blade holder 218 so that the fold flaps can receive the fold blade holder within the folder assembly. The fold flaps begin the deformation of the sheet into a folded shape, but without producing a sharp fold line. The fold flaps also reduce the force required to initiate a fold by pressing the sheet at some distance from the fold blade 217, an important feature when folding heavier weight papers and card stock.

Between the fold flaps 230, FIGS. 14 and 15, are found a plurality of pinch wheel assemblies 231 that initially capture the sheet on the fold blade 217 and anchor the sheet in place during folding. The number of pinch wheel assemblies, their location and spacing are determined by the various widths of the sheets being folded so that during operation of the fold mechanism 210 no pinch wheel transversely crosses the margin of a sheet going from the bare fold blade 217 on to the sheet itself, thereby possibly subjecting the mechanism to a paper jam or possibly crumpling or cutting the sheet.

Each pinch wheel assembly 231 includes a pinch wheel 232 mounted on an axle 233 which in turn is mounted on an axle mounting 234. The axle mounting is supported by a vertical shaft 335 that is spring loaded downward within the folder assembly 211. The vertical shaft permits vertical translation of the pinch wheel assembly 231 during operation. In the preferred embodiment the pinch wheel 232 has a concave cylindrical face, but the face can also be convex or flat as well. The pinch wheel is free to spin about the axle 233 and is fabricated from a hard, non-deformable material such as plastic or metal. The axis of rotation of each axle 233 is parallel to the others and the axle mounting is captured so as not to rotate the pinch wheel about the vertical shaft 235. The axle mounting 234, the axle 233 and the pinch wheel 232 are vertically spring loaded so that the folder assembly 211 may continue to translate downward after the pinch wheel 232 has engaged the sheet against the fold blade 217 thereby anchoring it in place during the fold operation.

The folder assembly 211, FIGS. 14 and 15 further includes a plurality of fold rollers 230. The fold rollers create the final shape of the fold in the sheet. They are fabricated from a hard material such as plastic or metal and freely rotate about their axles 240. The axis of rotation of all of the fold rollers are parallel to each other and to the path 60 of the paper. Each fold roller has a deep V-groove located in its circumferential circular surface. This V-groove receives the fold blade 217 and the sheet folded over it. The width of the V-grove at its minimum radius is sufficient to fit the fold blade and a doubled-over sheet. The number and spacing of the fold rollers is such that during the horizontal translation of the folder assembly 211, at least one fold roller passes over every point along the entire apex of the fold. In the present embodiment, thirteen fold rollers are used for folding paper measuring 11 inches in the transverse dimension.

To accommodate sheets of varying thickness and especially heavy card stock used for covers and inserts, self-adjusting fold rollers can be employed. A self-adjusting fold roller comprises two complementary disks spring loaded together on a common axle. To achieve a V-groove, each disk has a tapered, inward facing, peripheral edge.

Figure 16:
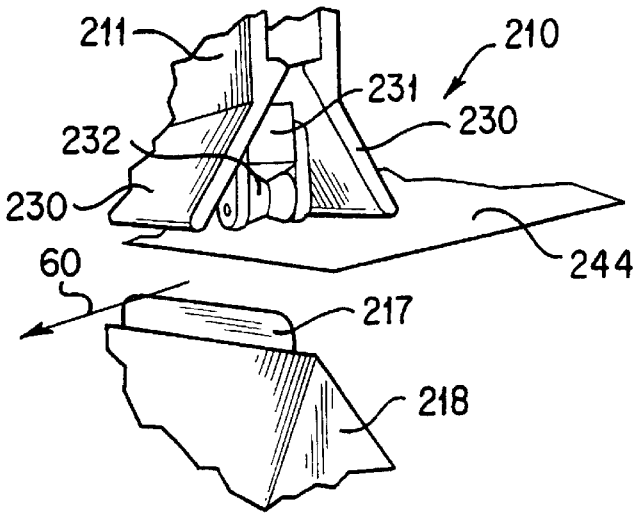
FIGS. 16–22, inclusive, are sequential diagrams illustrating the operation of the fold mechanism of FIG. 7.

The operation of the fold mechanism 210 is illustrated in FIGS. 16–22, inclusive. The paper dive assembly 140, FIG. 9 advances a sheet 244 a predetermined distance into the fold mechanism 210. The distance is determined by the desired width of the booklet and the location of the sheet in the booklet, as described above. Referring to FIG. 16, the paper drive assembly precisely positions the sheet 244 so that the location where the fold is desired is placed directly over the fold blade 217.

Figure 17:
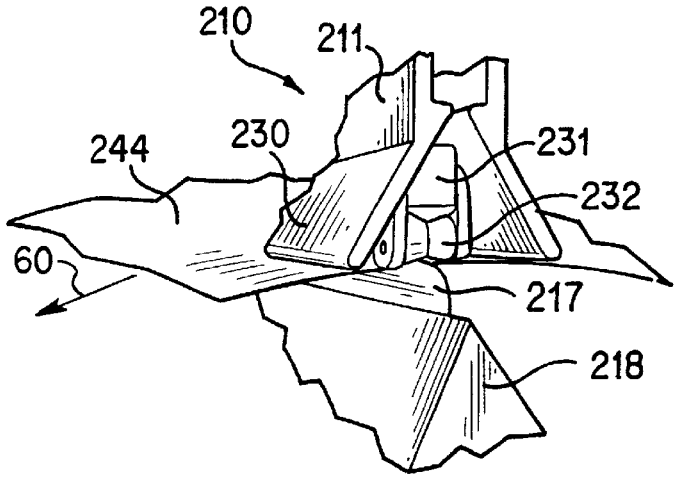
Figure 18:
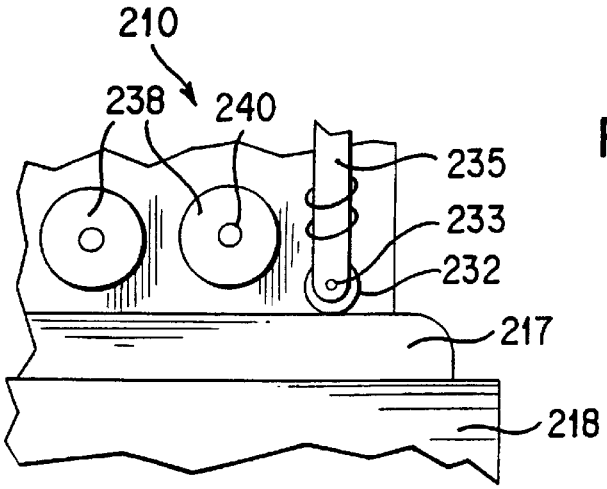
Figure 19:
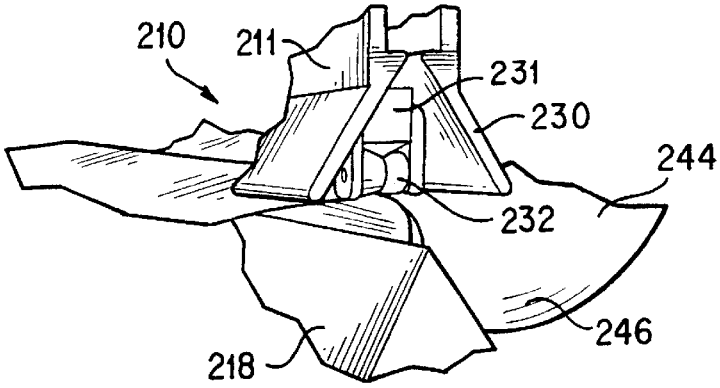

Referring to FIG. 17, once the sheet 244 is precisely in position over the fold blade 217, the folder assembly 211 translates downward through actuation of the vertical drive motor assembly 212, FIGS. 14 and 15. The first contact between the folder assembly 211 and the fold blade 217 occurs when the pinch wheels 232 capture the sheet 244 against the fold blade 217, FIGS. 17 and 18. At this point the sheet is held tightly between the pinch wheels and the edge of the fold blade 217.

The folder assembly 211 continues to translate downward and the fold flaps 230 start to contact the sheet 244 as illustrated in FIG. 17 and to bend the sheet downward over the top of the fold blade 217. The sheet 244 remains captured between the pinch wheels 232 and the fold blade 217. The paper drive assembly 140, FIG. 9, which has not moved since positioning the sheet over the fold blade 217, now advances the sheet to form a slack loop 246, FIG. 19, beside the fold blade holder 218. The direction of curvature of the slack loop is determined by contact with the fold flaps 230. The slack loop provides clearance for the sheet 244 so that the fold can be pressed into place by the folder assembly 211.

The folder assembly 211 continues downward with the pinch wheels 232 capturing the sheet against the fold blade 217. The vertical shafts 235, FIGS. 14 and 15, permit the pinch wheel assemblies 231 move vertically relative to the folder assembly 211. The fold flaps 230 continue to shape the fold over the fold blade 217 as the folder assembly descends.

Downward motion of the folder assembly 211 ends when the V-groves 241 in the fold rollers 238 have fully received the fold blade 217 and the now folded-over sheet. Although for clarity FIG. 20 does not illustrate the sheet, FIG. 20 shows the penetration of the fold blade 217 into the V-groves of the fold rollers 238.

Figure 20:
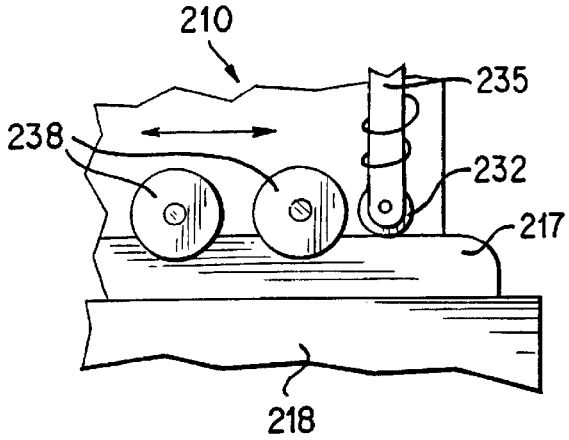

Thereafter, the folder assembly 211, FIG. 20 is moved transversely back and forth along the fold blade 217 by the horizontal drive motor assembly 220, FIGS. 14 and 15, to fully crease the sheet all along the length of the fold. The fold rollers 238 are spaced apart and travel a horizontal distance sufficient to insure that every point along the edge of the fold is contacted and creased by at least one fold roller.

Figure 22:
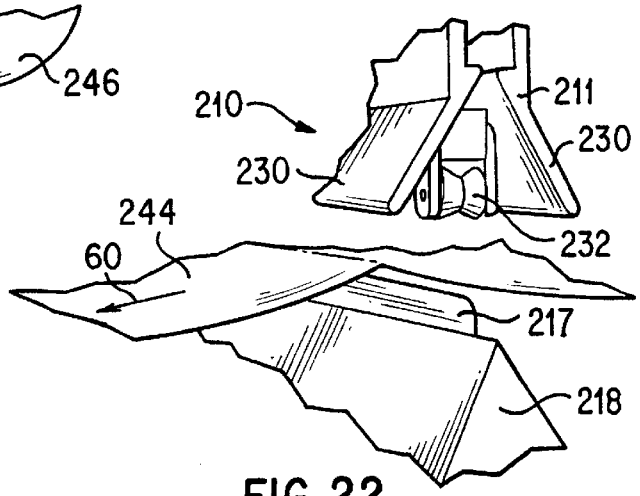

Once the fold is fully formed in the sheet 244, the fold assembly 211 is translated upward and out of the paper path by the vertical drive motor assembly 212, FIGS. 14 and 15. In so doing the pinch rollers 232 release the sheet from the fold blade 217. The sheet is ejected from the fold mechanism 210 by having the paper drive assembly 140, FIG. 9 wind up the slack loop 246, FIG. 19. The paper drive assembly moves sheet 244 no further backward than the starting point for creating the slack loop. During this process of winding up the slack loop, the sheet 244 pops off the fold blade 217 as illustrated in FIG. 22. The sheet is now ready to be picked by the secondary paper drive and handed off to it, as described in detail below.

The booklet maker can be operated to put two or more folds in each sheet. Sheets with two folds in the same direction, for example, called "C-folds" or "U-folds", are used for covers on large books and in booklets as fold-out pages and for center-fold sheets. To perform this operation, the paper drive assembly 140, FIG. 9 precisely positions the sheet over the fold blade for each fold and the fold is made in the manner described above. The booklet maker can also be operated to put a so-called "Z-folds" and "W-folds" in sheets. This involves folds in opposing directions. Two fold mechanisms 210 are used, one positioned upright with an upward projecting fold blade and the other positioned upside down with its fold blade downwardly projecting. To make the Z-fold, the paper drive assembly 140, FIG. 9 precisely positions the sheet over each fold blade at the appropriate point for each fold and the fold is made in the manner described above.

The lead screw assemblies in the fold mechanism 210 produce high mechanical advantage allowing DC servo motors to produce the forces required to fold a thick sheet, such as card stock. But, other actuators, such as four-bar linkages, slider-crank mechanisms, pulleys and belts, rack and pinions, and linear actuators such as soleniods, linear electric motors, and hydraulic or pneumatic cylinders, can be used instead of the lead screw assemblies for vertical and horizontal translation of the folder assembly 211.

The horizontal drive motor can be eliminated by putting the fold rollers on pivoting arms so that when they translate downward, the fold rollers also slide along the fold as well. To reduce the vertical travel of the folder assembly, the fold flaps can be gear driven to spring out and push the sheets down.

Booklet Collection Assembly

Figure 23:
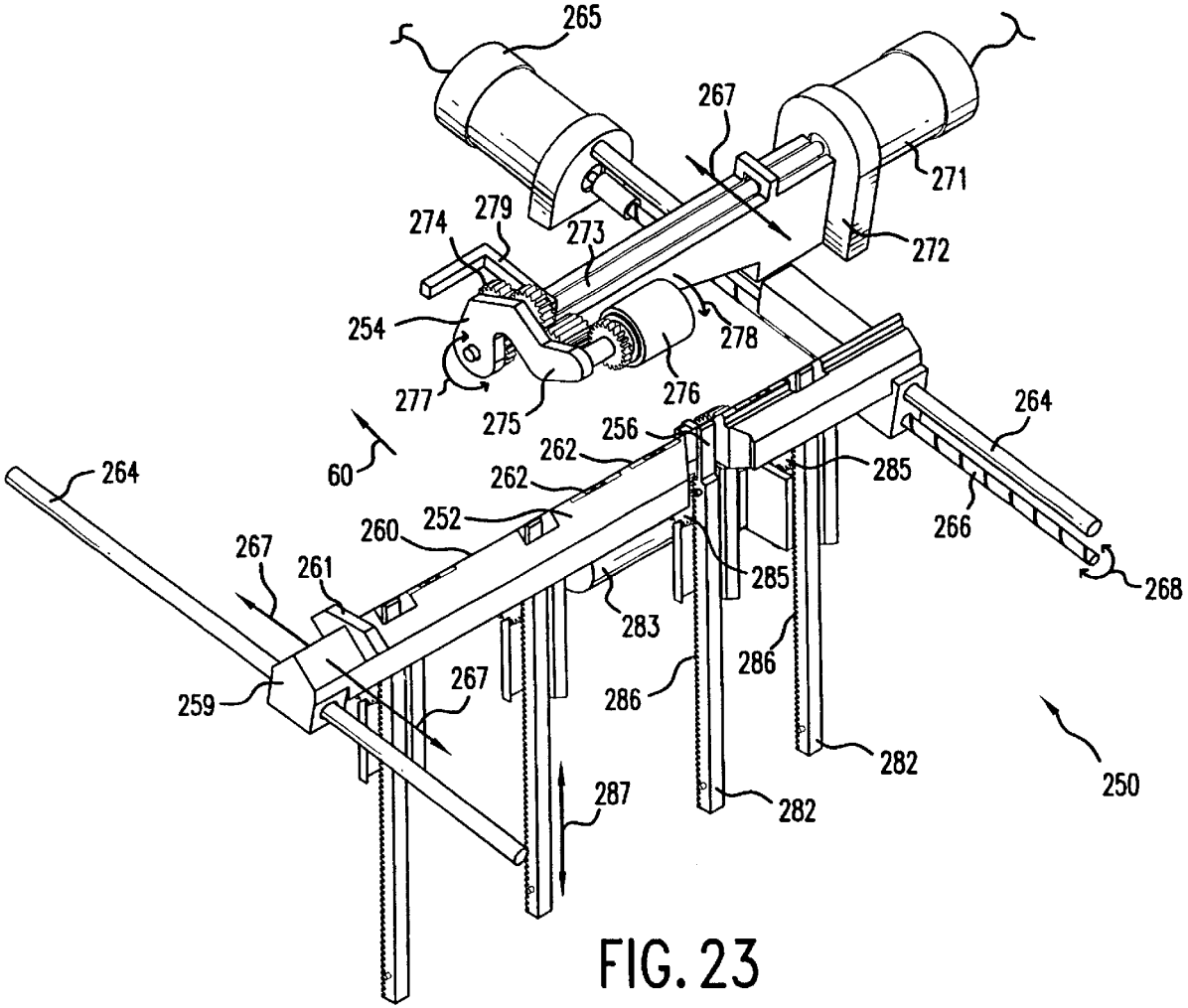
FIG. 23 is an isometric top view of the booklet collection assembly of FIG. 7, partially cut away.

Referring to FIG. 23, reference numeral 250 generally indicates a booklet collection assembly for gathering the sheets together after folding and for aligning them for stapling. The booklet collection assembly includes three subassemblies: a saddle assembly 252, a secondary paper drive assembly 254, and an ejection finger assembly 256. The saddle assembly 252 collects the sheets after each has been folded, provides a stop for squaring up the sheets, and provides an anvil for stapling the sheets together. The secondary paper drive assembly 254 is separate from the paper drive assembly 140, FIG. 9 and moves the sheets after they have been folded and leave the fold mechanism 210, FIGS. 14 and 15. The secondary paper drive assembly 254 is attached to the saddle assembly and translates with it. The ejection finger assembly 256 lifts the booklet up and off the saddle after the booklet is stapled. The ejection finger assembly 256 is also attached to the saddle assembly and translates with it.

In particular, the saddle assembly 252, FIG. 23 includes a saddle 259 that is an elongate, movable bar or workpiece having an inverted V-shape that extends transversely across the booklet maker and acts to collect the sheets after each has been folded and prior to being stapled. The saddle 259 has a saddle peak 260 which is a sharp edge along the top margin of the saddle. The saddle peak is a datum that lines up the folds in the sheets. Each fold is indexed by the saddle peak and lines up along the saddle peak after leaving the fold mechanism 210, FIGS. 14 and 15. The saddle 259 also has an edge stop 261 against which all of the folded and stacked sheets are aligned before stapling. An arm on the stapler carriage, described below, tamps the sheets and squares the sheets against the edge stop 261. Along the saddle peak 260 are a series of anvils 262 against which the staples are pushed during stapling. The anvils clinch the tips of the staples together as the staples are driven into each booklet. The anvils are positioned to clinch two staples together in smaller booklets and three staples in larger booklets. The saddle 259 translates back and forth along a pair of parallel, inclined, slider rods 264 which support the entire booklet collection assembly 250. The slider rods are stationary. The slider rods are inclined upward in the direction of the paper path indicated by the arrow 60 so that when the saddle 259 is moved toward the fold mechanism 210, FIG. 14, the saddle comes to rest at a location below and under the location of the fold in the sheet when the sheet is released from the fold blade 217, FIG. 22. In other words, the folded sheets come out of the fold mechanism, pass partially over the saddle 259, and come to rest aligned with the folds on the saddle peak 260. The saddle 259 as well as the secondary drive assembly 254 and the ejection finger assembly 256 are translated back and forth by a saddle drive motor 265 and a lead screw 266. The saddle drive motor is a DC servo motor actuated by the drive motor controller 362. The saddle moves in the direction indicated by the arrows 276 by the rotation of a lead screw 266 indicated by the arrow 268.

Other types of linear actuators beside a lead screw may be used for the translation of saddle 259, secondary drive assembly 254, and the ejection lift assembly 256.

In FIG. 23, the secondary drive assembly 254 is rigidly mounted on the saddle assembly 252 and is translated with it along the slider rods 264. The secondary drive assembly 254 includes a secondary drive motor 271which is a DC servo motor actuated by the motor controller 362. The secondary drive motor is mounted on a frame 272 that is rigidly attached to the saddle assembly 252. The secondary drive motor rotates a shaft 273 and a gear train 254 which together rotate an arm 275 and a drive tire 276. The drive tire 276 turns in only one direction as indicated by the arrow 278. The gear train 254 contains a roller clutch, not shown, and the arm 275 can turn either clockwise or counterclockwise about the shaft 273 as indicated by the arrow 277.

Figure 24:
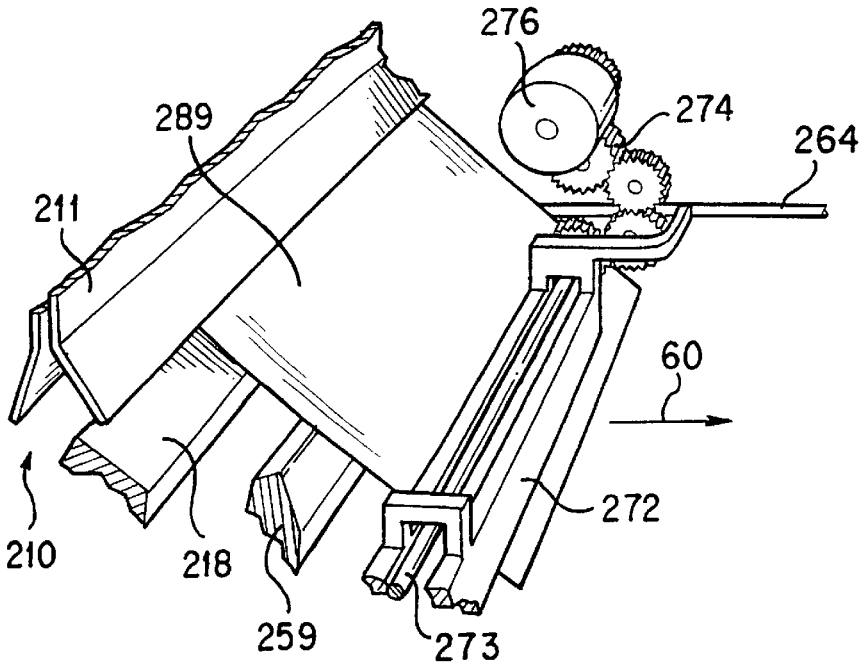
FIGS. 24–28, inclusive, are sequential diagrams illustrating the operation of the booklet collection assembly of FIG. 23.

When the shaft 273 is rotated counter clockwise as illustrated in FIG. 24, the gear train 274 turns the arm counter clockwise so that the drive tire 276 rotates around and into contact with the saddle 259. The gear train 274 also rotates the drive tire 274 counter clockwise as indicated by the arrow 278. If a sheet is present in the booklet collection assembly 250, the sheet is captured between the drive tire 274 and the saddle 259. The sheet is also translated in the direction of the paper path, indicated by the arrow 60, by the counter clockwise rotation of the drive tire 274 so that the fold in the sheet is collected on the saddle peak 260. Since after trimming each sheet has a different width, a means is required to align each trimmed sheet not to an edge but to its center fold. Sheets are aligned with respect to each other by accumulating them with their center fold resting on the saddle.

Figure 28:
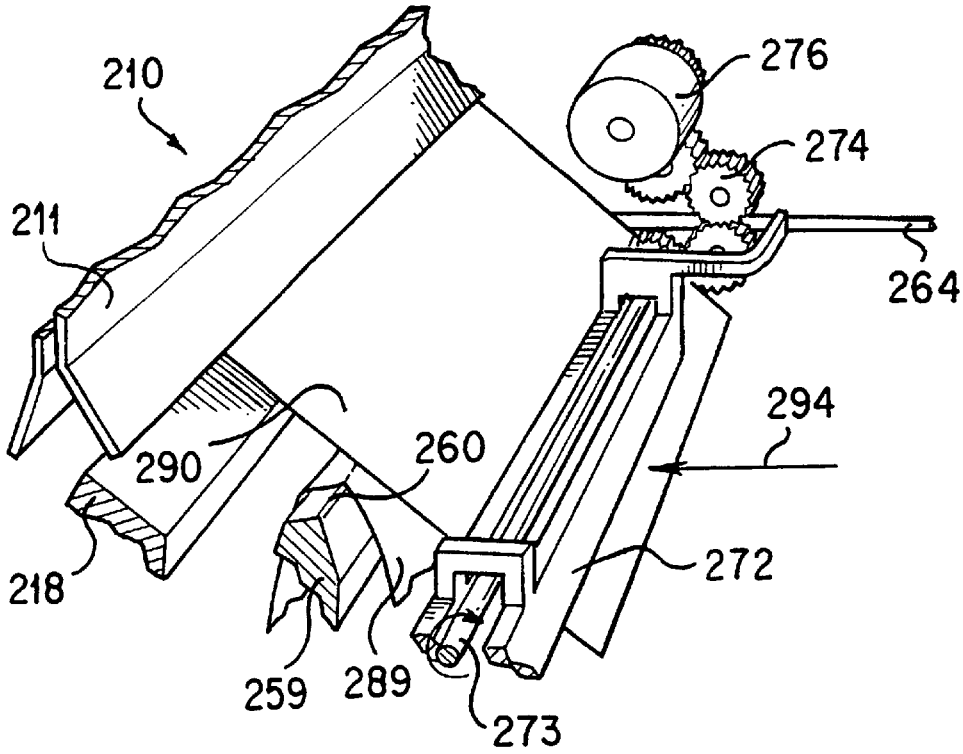

When the shaft 273 is rotated clockwise as illustrated in FIG. 28, the roller clutch in the gear train 274 locks the gear train and the arm 275 and the drive tire 276 rotate clockwise about the shaft 273. The drive tire swings off the saddle 259 and out of the way of the sheet. Complete clockwise rotation of the arm 275 and drive tire 276 is stopped by a back stop 279.

In FIG. 23, the booklet collection assembly 250 includes an ejection finger assembly 256 that is mounted on and travels with the saddle 259. The ejection finger assembly lifts a booklet off the saddle after the booklet has been stapled. The ejection finger assembly includes a series of vertical fingers 282 that vertically translate with respect to the saddle. The vertical fingers are moved by an ejection finger drive motor 283 that is actuated by the motor controller 362. The ejection finger drive motor 283 is a DC servo motor that turns a shaft, not shown, that in turn, rotates a series of gears 285. Each gear engages a gear rack 286 located along the elongate side of each finger. The direction of rotation of the ejection finger drive motor causes the fingers to either raise or lower with respect to the saddle. The fingers 282 normally sit fully retracted into the saddle and in their lowest position. When the drive motor 283 and the gears 285 rotate counterclockwise, as illustrated in FIG. 23, the fingers 282 lift a stapled booklet off of the saddle and into a booklet stacker described below.

The operation of the booklet collection assembly 250, FIG. 23 is illustrated in FIGS. 24–28. The normal and initial position for the booklet collection assembly is with the saddle 259 positioned near the fold blade holder 218 and below the fold blade 217, FIG. 16. The secondary drive tire 276 is rotated up and out of the way of the paper path, the arrow 60. In FIG. 24 the fold mechanism 210 is accepting a sheet 289 to be folded, in the manner described and illustrated in FIG. 16 for the sheet 244. The sheet 289 is translated by the main paper drive 140, FIG. 9 and moves over the underlying peak of the saddle 259.

Figure 21:
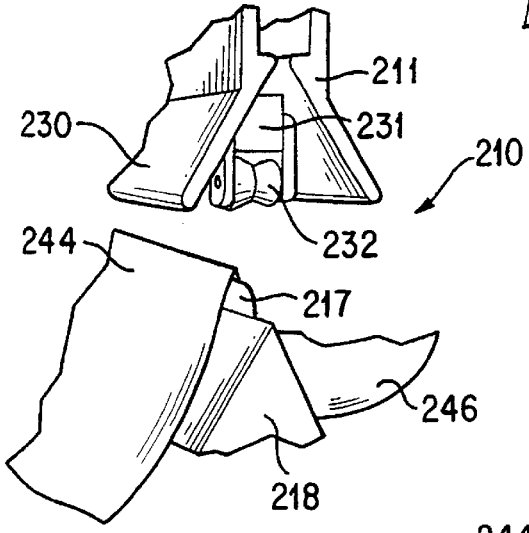
Figure 25:
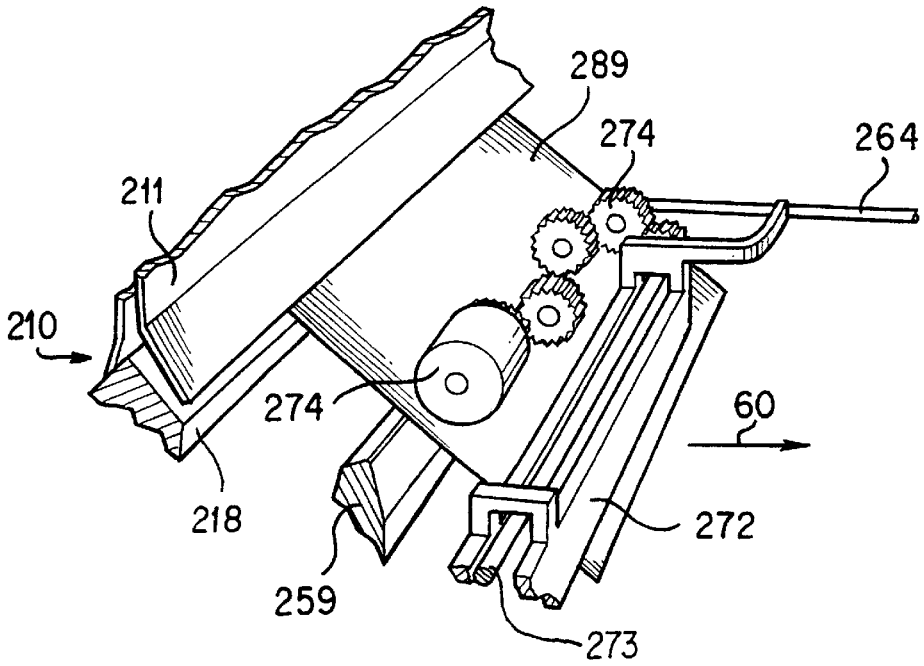
Figure 26:
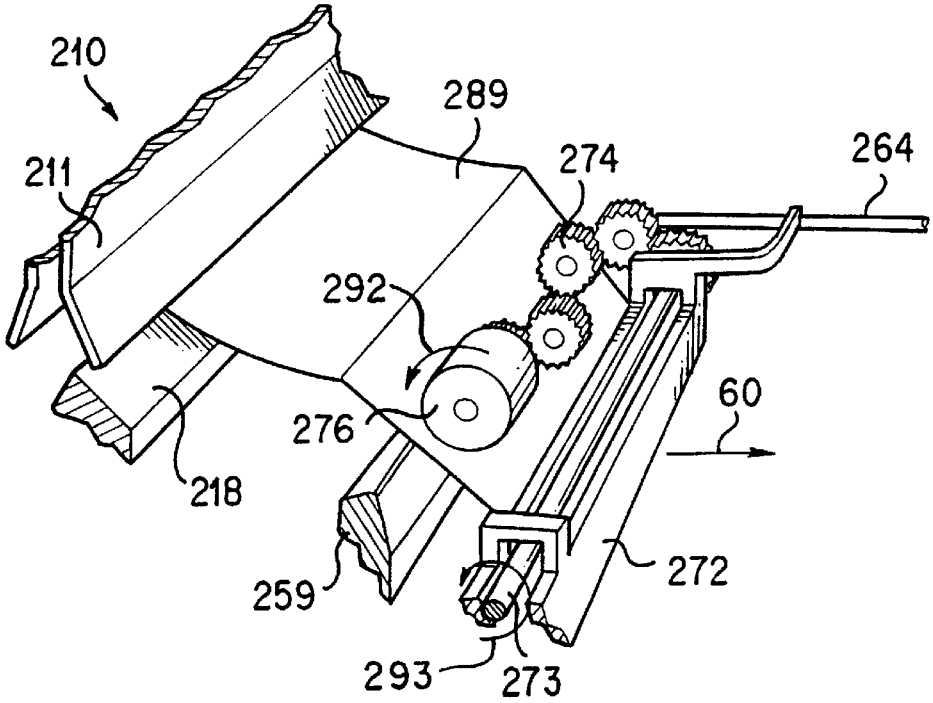

Thereafter, the process for folding the sheet is performed by the fold mechanism 210, described above and illustrated in FIGS. 17–20. After the slack loop 246, FIG. 21 is removed, the secondary drive tire 276 is rotated down by motion of the shaft 273. The secondary drive tire 276 captures the sheet 289 against the saddle 259 as illustrated in FIG. 25. The tire is lightly loaded against the saddle. Then three operations occur nearly simultaneously. The entire booklet collection assembly 250 translates along the slider rods 264, FIG. 24 in the direction of the paper path, arrow 60, by rotation of the lead screw 266; the main paper drive 140, FIG. 9 advances the sheet 289 until the sheet is no longer held by the main paper drive; and the secondary drive tire 276 commences to rotate in the direction indicated by the arrow 292 through rotation of the shaft 273 in the direction indicated by the arrow 293. The motion of the saddle 259 and the secondary drive tire 276 pulls the sheet 289 from the fold mechanism 210 as illustrated in FIG. 26. Thereafter, the sheet clears the fold mechanism.

Figure 27:
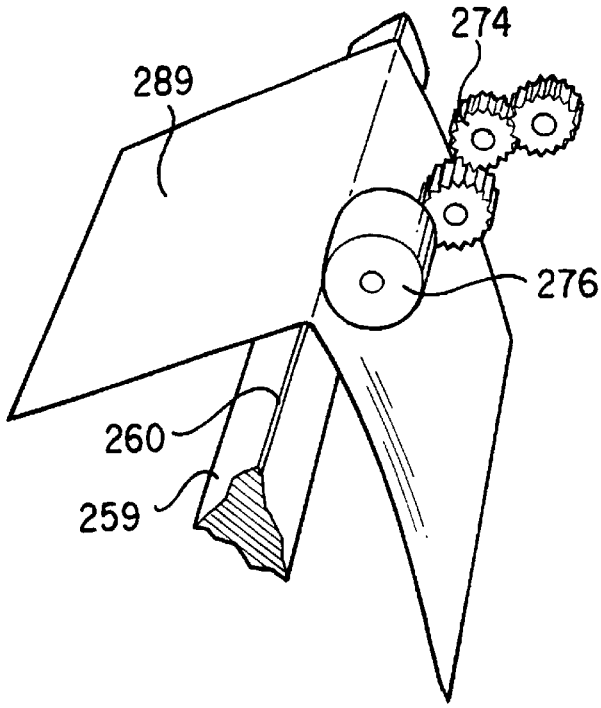

The secondary drive tire 276, FIG. 27 continues to rotate until the fold in the sheet 289 indexes on the peak 260 of the saddle 259. The drive tire is lightly loaded against the saddle so that after the sheet indexes, the sheet moves no further and the drive tire skids on the sheet. The peak 260 of the saddle 259 thereby squares up and registers each sheet after being folded to its center fold.

Referring to FIG. 28, the secondary drive tire 276 is next rotated up and out of the paper path and the saddle 259, with the folded sheet 289 indexed on its peak 260, returns to the fold blade holder 218 as indicated by the arrow 294. This is the normal and initial position for the booklet collection assembly 250 described above in connection with FIG. 24. The folding process is repeated with the next sheet 290 passing over the underlying, previously folded sheet 289 as illustrated in FIG. 28.

The folding and stacking process is repeated over and over, sheet by sheet, until all of the sheets for a booklet are cut, folded, and stacked. The stacked sheets are now justified by their top (or bottom) edge against a stop on the saddle completing their alignment for stapling. Stapling at this point, to be described below, will produce a booklet with all paper edges aligned and square. Thereafter the ejection fingers 282 are translated vertically upward and the stapled booklet is lifted off of the saddle 259. The secondary drive tire 276 has been rotated up and out of the way beforehand as illustrated in FIG. 24. The booklet is translated by the ejection fingers either into a booklet unloader described below or the booklet is manually stripped off of the fingers and stacked. The ejection fingers are thereafter translated vertically downward into the saddle 259 and process is repeated for the next booklet.

Stapler Assembly

Figure 29:
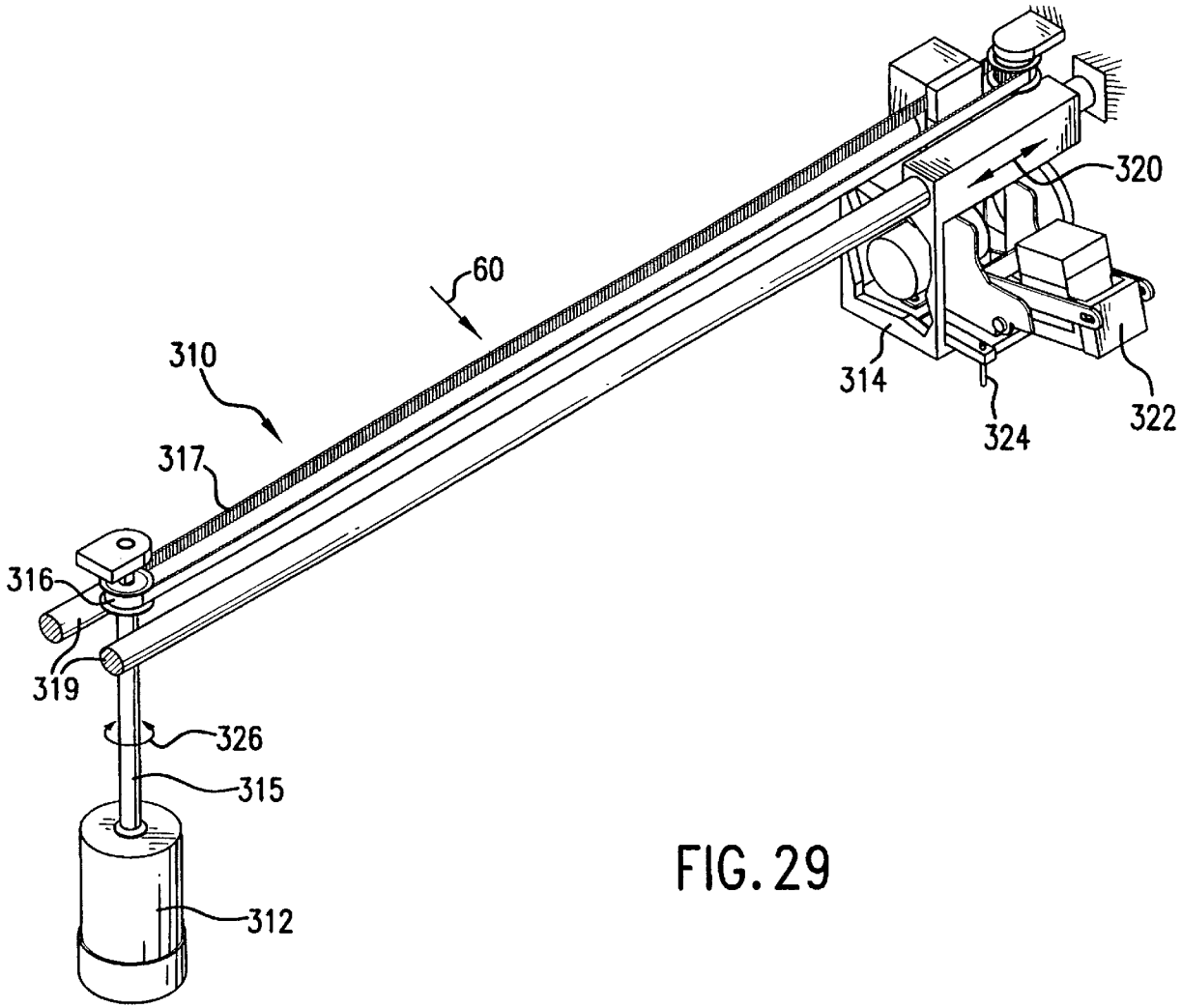
FIG. 29 is an isometric top view of the stapler assembly of FIG. 7, partially cut away.

Referring to FIG. 29, reference numeral 310 generally indicates a stapler assembly for the booklet maker. The stapler assembly is positioned further down the paper path 60 from the fold mechanism 210. After all of the sheets for a booklet have been cut, folded, and stacked on the saddle 259, the stapler assembly 310 squares up the stack of sheets, top to bottom, and then staples the booklet together.

The stapler assembly 310, FIG. 29 includes a stapler drive motor 312 that translates a stapler carriage 314 by rotation of a drive shaft 315, a pulley 316, as indicated by the arrow 326, and a drive belt 317. The stapler drive motor 312 is a DC servo motor that is actuated by the motor controller 362. The stapler carriage 314 is a frame that moves transversely across the paper path 60 and transversely across the booklet maker as indicated by the arrow 320. The stapler carriage is supported for this motion by two, parallel, stationary, slider rods 319. The stapler carriage 314 transversely moves a commercially available stapler mechanism 322 of conventional construction. The stapler mechanism 322 is electrically actuated as required by the motor controller 362.

The stapler assembly 310, FIG. 29 also includes a stack justify pin 324. The stack justify pin is a vertical member, which may be rigid or flexible, that squares up the stack of folded sheets, top to bottom, on the saddle 259 , FIG. 23, before the stack is stapled together. The stack justify pin is fixed relative to the stapler mechanism 322 and is downward pointing.

In operation, the stapler assembly 310 normally rests out of the paper path 60, FIG. 29. After the sheets for a booklet have been cut, folded, optionally punched or drilled, and stacked, the saddle 259, FIG. 23 is translated longitudinally in the direction indicated by the arrow 267 by the saddle drive motor 265 to a position directly opposite and below the stack justify pin 324. The stapler drive motor 312 is then actuated so that the stack justify pin 324 moves parallel to the peak 260, FIG. 23, of the saddle 259 and squares up the stack of folded sheets, top to bottom, against the edge stop 261, FIG. 23 on the saddle assembly 252. The sheets have been resting on the saddle 259, and have been aligned to their center folds by the saddle peak 260.

Next, the saddle assembly 252, FIG. 23 and the stapler assembly 310 are moved with respect to each other so that the stapler mechanism 322 is positioned, in turn, over each of the stapling anvils 262 located in the saddle peak 260. At each anvil, the stapler mechanism is actuated, a staple is driven into the fold in the stack of sheets, and the staple is cliched in the conventional manner by the associated anvil. In this embodiment, there are five anvils located along the saddle peak 260 so that two staples can be driven into small booklets and three into larger booklets.

After stapling the booklet, the stapler assembly 310, FIG. 29 is moved to its standby position, off to one side of the paper path 60 and the folding and stacking equipment.

It is also contemplated that the booklet maker may be used in ways to finish sheets where sheets are not stapled. Single folded sheets and tri-folded brochures can be assembled by the booklet maker as described herein without stapling. The stapler assembly, in this case, need not be actuated or even included on the machine.

Booklet Unloader

Figure 30:
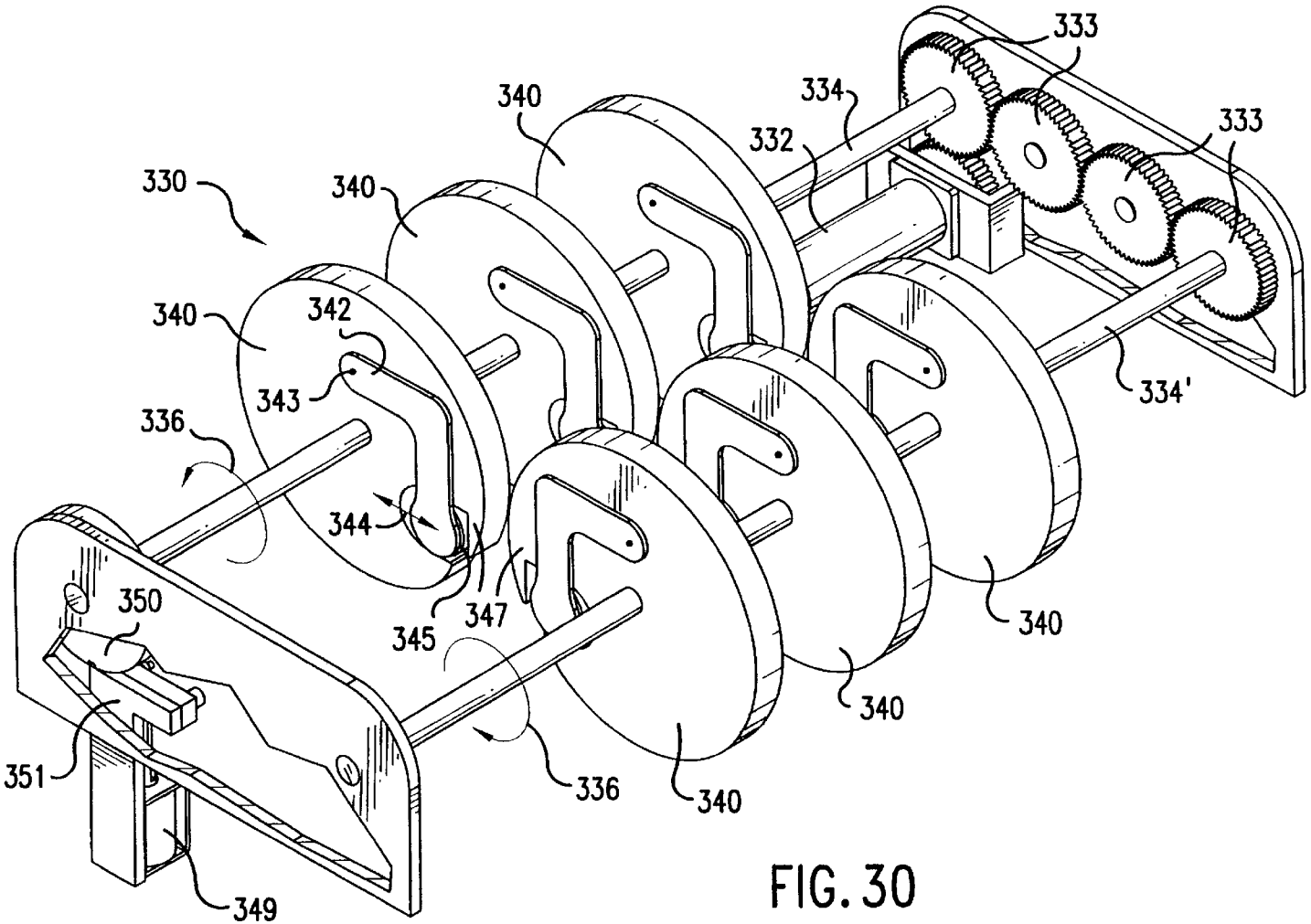
FIG. 30 is an isometric top view of the booklet unloader of FIG. 7, partially cut away.

Referring to FIG. 30, reference numeral 330 generally indicates a booklet unloader for the booklet maker. The booklet unloader removes the stapled booklets from the ejection fingers 282, FIG. 23, when the ejection fingers vertically translate and lift the booklet off of the saddle 259, FIG. 23. The booklet unloader then wraps the booklet over and discharges the booklet into one of two output trays.

The booklet unloader 330, FIG. 30, includes an unloader drive motor 332 that is actuated by the motor controller 362.

The unloader drive motor is a DC motor but can be a stepper motor of conventional construction. The unloader drive motor 332 powers a gear train 333 that in turn counter rotates two parallel drive shafts 334. The drive shafts counter rotate in the directions indicated by the arrows 336.

Rigidly mounted for rotation on each of the drive shafts 334, FIG. 30 are three identical disk assemblies 340. Each disk assembly turns with its associated drive shaft 334, all six turning together simultaneously, and all are rotated by the unloader drive motor 332 through the gear train 333. While all the disk assemblies 340 rotate together, each booklet is pushed into either one set of three disks or the other set, one booklet at a time. Two sets of three disk assemblies are used so that the booklets can be unloaded into either a front or rear output tray as described below.

Each identical disk assembly 340, FIG. 30, includes an L-shaped arm 342 that pivots about a shaft 343 in the direction indicated by the arrow 344. Located at the free end of the arm 342 is a roller 345 that contains a roller clutch within, not shown. The roller 345 swings at the end of the L-shaped arm 342 within an opening cut through the disk. The opening forms a lip 347 in the periphery of the disk. When a booklet is pushed into the opening between the roller 345 and the lip 347, the roller clutch allows the booklet to enter easily but not to easily pass back out. The opening, the L-shaped arm 342, the shaft 343 and variable gap between the roller 345 and the lip 347 permit the booklet unloader to accommodate booklets of various thickness.

The booklet unloader 330, FIG. 30, further includes a solenoid 349, a cam 350, and a cam lock 351 that lock the drive shafts 334 in position as illustrated in FIG. 30 after making one complete revolution.

In operation, the saddle assembly 252 carrying a stapled booklet is first positioned below one of the two sets of three disk assemblies 340. Either set may be used, but the set that is used determines into which output tray the booklet is finally stacked. The stapled booklet is next translated vertically upward and off of the saddle 259, FIG. 23 by the vertical motion of the ejection fingers 282. The ejection fingers are driven by the ejection finger drive motor 283 through the gears 285 and the gear racks 286. The ejection fingers 282 push the spine of the booklet into the gap between the roller 345 and the lip 347 on each of the disk assemblies 340. The roller clutch within each roller allows the booklet to easily enter the gap but then retains the booklet in place by locking the backward rotation of the roller 345. The ejection fingers 282 are thereafter retracted vertically downward into the saddle assembly 252 to the position illustrated in FIG. 23. Next, the unloader drive motor 332, FIG. 30 is energized and the disks rotate in the directions indicated by the arrows 336. The booklet wraps around the circular periphery of the disks and then is stripped off of the booklet unloader by the output tray as described below. The shafts 334 and the disk assemblies 340 make one complete revolution and come to rest again in the position illustrated in FIG. 30. The solenoid 349, the cam 350, and the cam lock 351 insure that the disk assemblies return to their original position.

Output Tray Assembly

Figure 4:
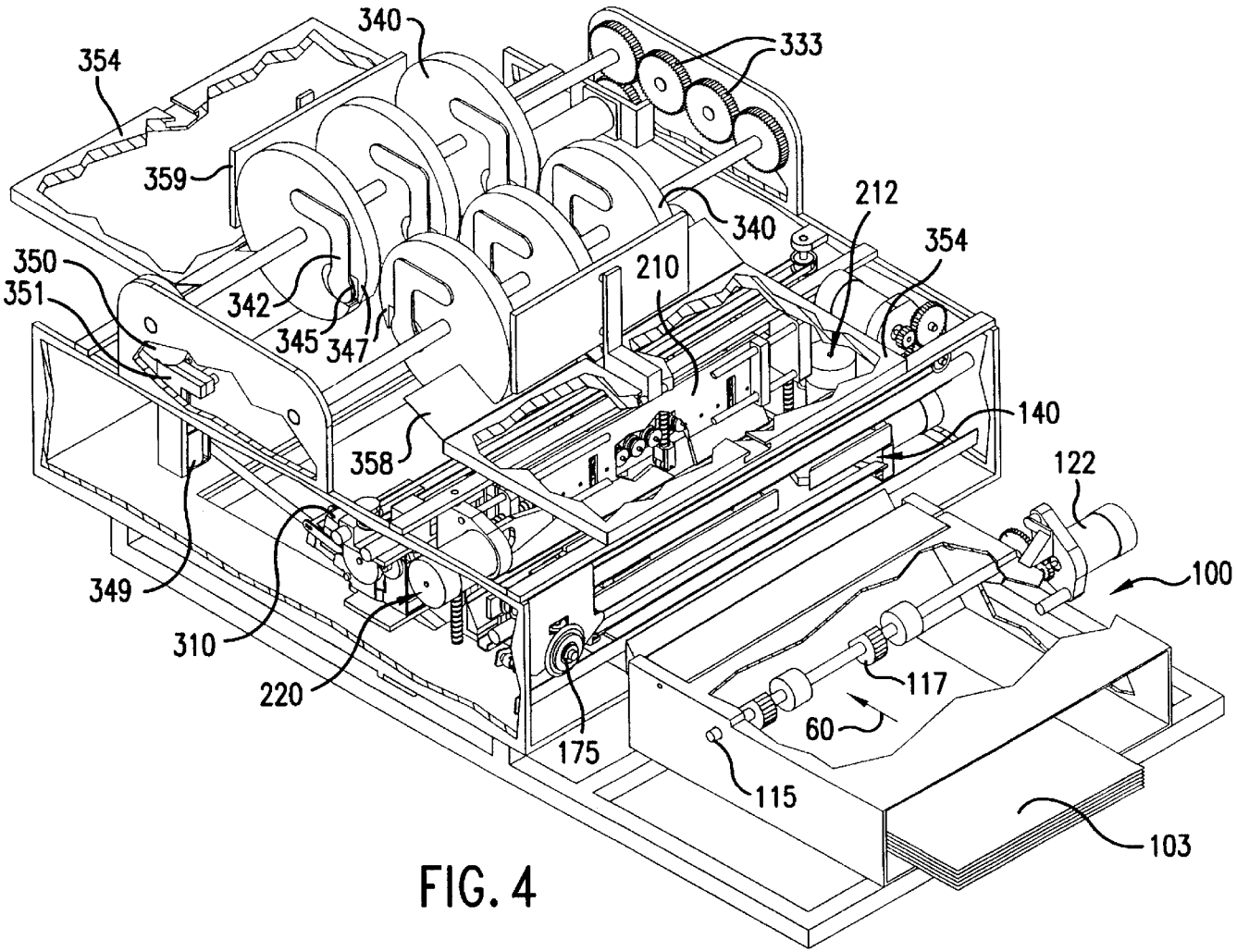
FIG. 4 is an isometric view of the present invention, partially cut away, illustrating the input of paper sheets in the near field.
Figure 5:
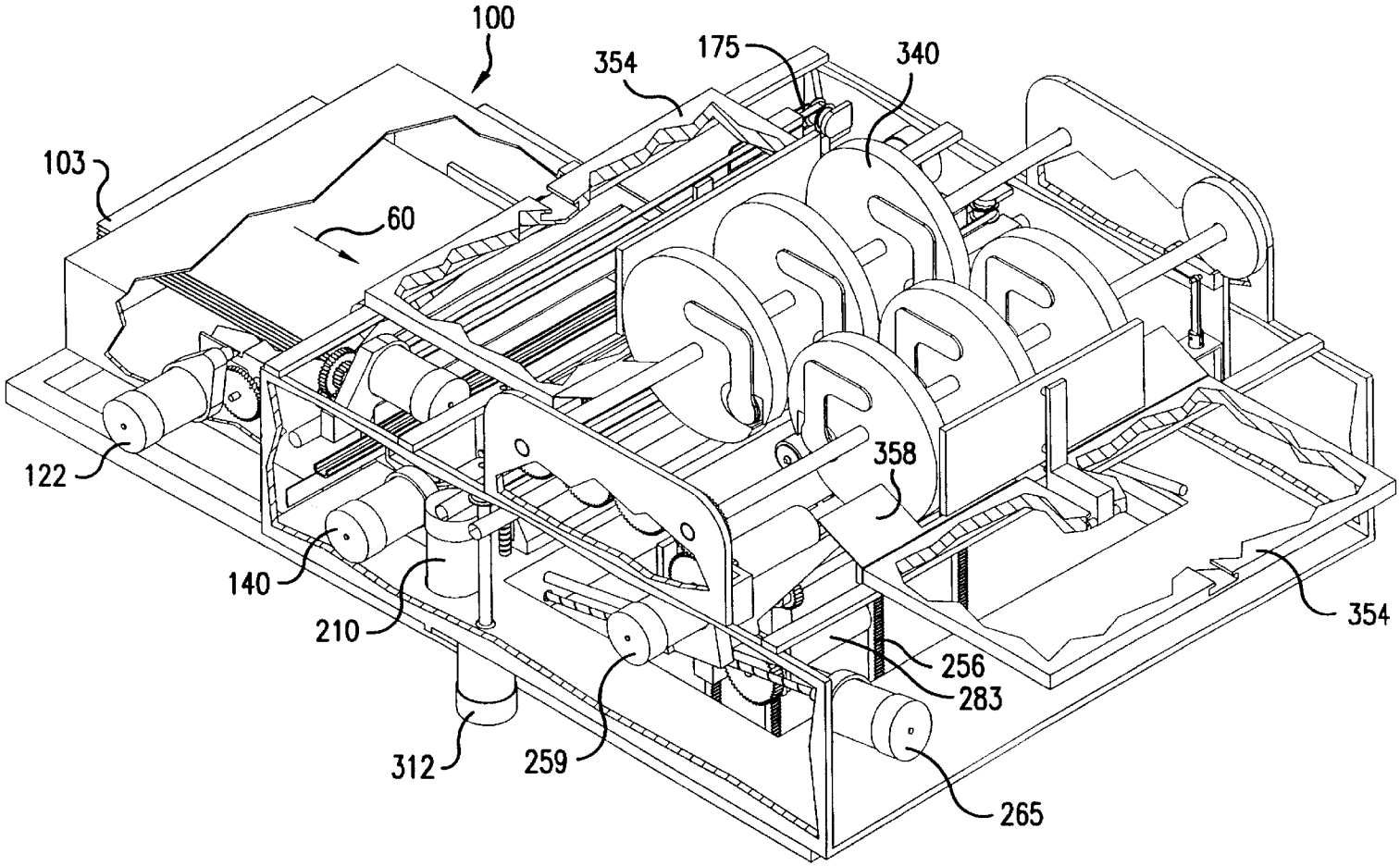
FIG. 5 is an isometric view of the apparatus of FIG. 4, partially cut away, illustrating the output of finished documents in the near field.
Figure 31:
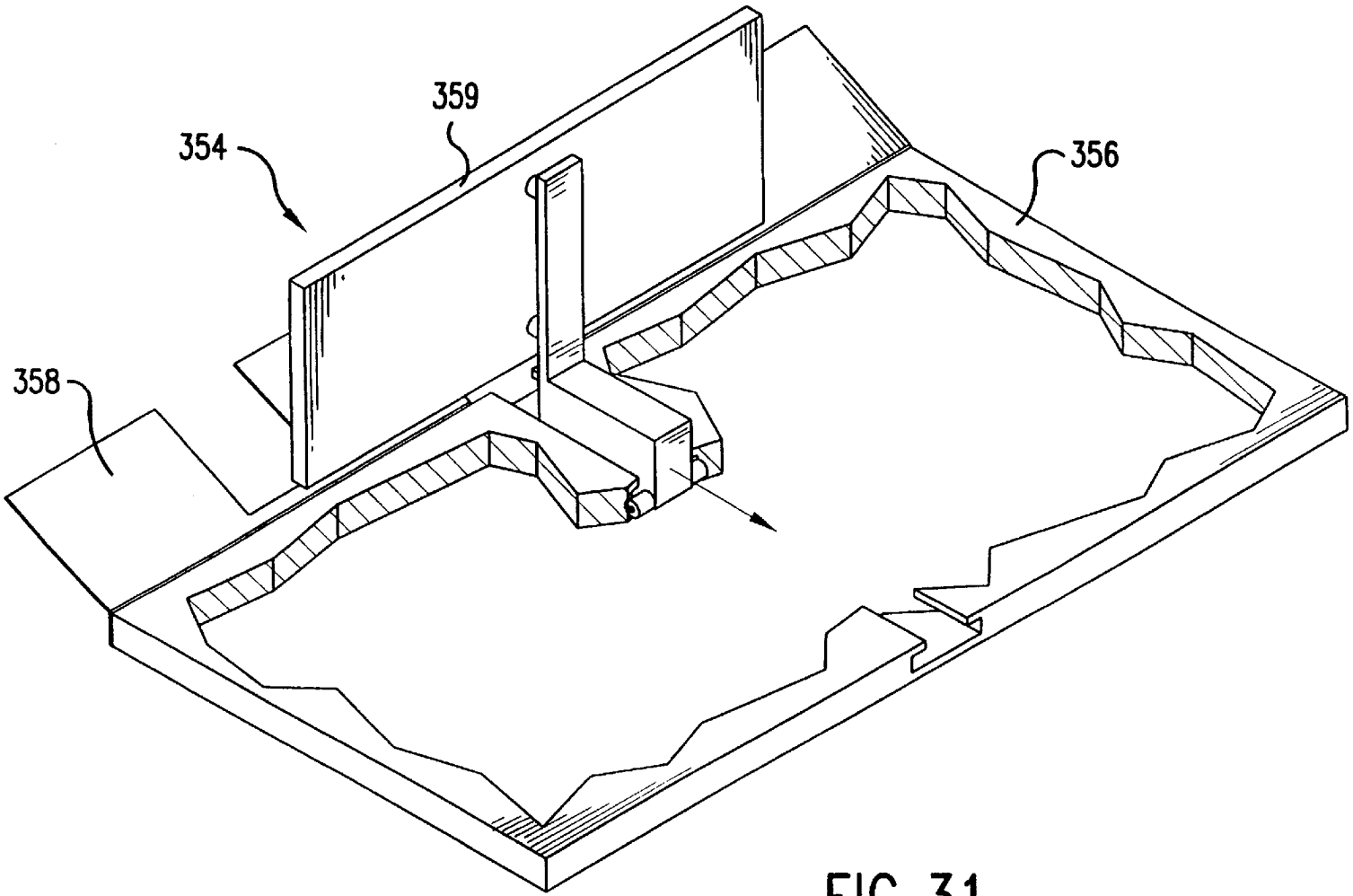
FIG. 31 is an isometric top view of the output tray assembly of FIG. 7, partially cut away.

Referring to FIGS. 7 and 31, reference numeral 354 generally indicates an output tray assembly that collects finished booklets. The booklet maker has two such output tray assemblies of identical construction and operation. Each output tray assembly 354 includes a tray 356, a stripper plate 358 and a paddle 359. The stripper plate has three rectangular slots that each receive one of the disk assemblies 340 of the booklet unloader 330, FIGS. 4 and 5. The tray is a horizontal surface on which the booklets are vertically stacked edgewise after leaving the unloader 330, FIG. 30. The paddle is a vertical surface that is spring loaded toward the stripper plate 358 and the disk assemblies 340. The paddle maintains the booklets upright and moves horizontally against the spring, not shown, as additional booklets are collected.

Referring to FIG. 30, after the spine of a booklet is pushed into the gap between the roller 345 and the lip 347 on each of the three disk assemblies 330, all six disk assemblies 330 rotate. The booklet is rolled over the circular periphery of the disks. The spine of the booklet next contacts the stripper plate 358, is stripped away from the disk assemblies, and is stacked vertically upright against the paddle 359. The disk assemblies make one full revolution and return to the position illustrated in FIG. 30.

Servo Motor Controller

Referring to FIG. 7, reference numeral 362 indicates a DC servo motor controller with eight axis of motion control. The controller is of conventional construction and receives sixteen input and output signals from the sensors and solenoids described above. In addition, other sensors along the paper path and within the functional modules may be included to insure that paper jams can be detected and that operations have been performed successfully. The controller precisely actuates all of the DC servo motors and controls all of the various processes conducted by the booklet maker. In an alternative embodiment, DC stepper motors can be used and controlled by a conventional stepper motor controller.

The controller is comprised of a digital processor, random-access memory, program storage memory, input signal conditioning for sensors and position encoders, output power control for DC motors, means of communicating with front panel switches and indicators including lights and a alphanumeric or graphical display. Optionally, the controller has means to communicate with a printer for implementation in an in-line configuration, with a host computer, or a network.

The controller sequences the selected finishing operations described above and detects error conditions if a sheet has not successfully passed through a selected operation or the selected operation has failed to start or complete properly.

Although specific embodiments of the invention have been described and illustrated, the invention is not to be limited to the specific forms or arrangement of parts so described and illustrated. The invention is limited only by the claims.

Industrial Applicability

The present invention has application in homes, offices, small and large work-groups, and in commercial and retail printing operations. The apparatus can produce finished documents off-line, receiving printed sheets into the input tray from various sources physically remote from the finisher; or in-line, receiving printed sheets directly from an attached printer. The printer can be a laser printer, an ink-jet printer, an off-set printing press, or other conventional or digital presses.

We claim:

1. Apparatus for assembling sheets of printing media for booklets, comprising:

a) a media trimmer that cuts the sheets, sheet-by-sheet, to predetermined widths;

b) a sheet folder, connected to the media trimmer, that folds the trimmed sheets, sheet-by-sheet, and c) a sheet stacker, connected to the sheet folder, that collects the folded trimmed sheets, sheet-by-sheet, in a stack, wherein each sheet has a position in the booklet being assembled and the media trimmer cuts the sheets to pre-determined widths depending on the position of the sheet in the booklet.

2. The apparatus of claim 1 wherein each sheet has a position in the booklet being assembled and a thickness and the media trimmer cuts the sheets, sheet-by-sheet, to pre-determined widths depending of the position of the sheet in the booklet and the thickness of each sheet.

3. The apparatus of claim 1 further including means, connected to the trimmer, folder, and stacker, for positioning the sheets, sheet-by-sheet, with respect thereto.

4. The apparatus of claim 1 further including a stapler, connected to the sheet stacker, that staples the stack of sheets together into a booklet.

5. The apparatus of claim 1 further including a punch, connected to the sheet folder, that punches a hole in the stack of sheets.

6. The apparatus of claim 1 further including a punch, connected to the sheet stacker, that punches out a notch in the stack of sheets.

7. The apparatus of claim 1 further including a second sheet folder, connected to the trimmer, that folds the sheets, sheet-by-sheet, with a fold opposite to the fold made by the first sheet folder, thereby making Z-shaped sheets.

8. Apparatus for assembling sheets for booklets, each sheet having a position in the booklet, said booklets when finished are folded and have an edge, comprising:

a) a paper trimmer that cuts the sheets, sheet-by-sheet, to predetermined widths depending on the position of the sheet in the booklet so that the edge of a finished, folded booklet formed from the sheets is flat as if all of the sheets had been trimmed together to final size;

b) a sheet folder, connected to the paper trimmer, that folds the trimmed sheets, sheet-by-sheet; and c) a sheet stacker, connected to the sheet folder, that collects the folded trimmed sheets, sheet-by-sheet, in a stack and registers the sheets, sheet-by-sheet on the fold in each sheet.

9. The apparatus of claim 8 wherein the sheet folder includes an elongate fold blade, a pinch roller that captures each sheet on the fold blade, and a fold roller that folds each sheet over the fold blade.

10. The apparatus of claim 9 wherein the sheet folder further includes two, elongate, outward opening, fold wings that initiate folding each sheet after the pinch roller captures each sheet.

11. The apparatus of claim 8 further including a paper feeder that loads the sheets, sheet-by-sheet, into the paper trimmer, said paper feeder being remote from a source of the sheets being made into booklets.

12. The apparatus of claim 8 further including a printer that loads the sheets, sheet-by-sheet, into the paper trimmer after each sheet is printed.

13. The apparatus of claim 8 further including a bar code reader connected to the apparatus for receiving job and media parameters from a machine readable job ticket.

14. The apparatus of claim 8 further including an unloader that removes the stacks of sheets from the apparatus.

15. Apparatus for assembling sheets for booklets, each sheet having a position in the booklet, comprising:

a) a paper feeder that loads the sheets, sheet-by-sheet, into the booklet maker;

b) a paper trimmer, connected to the feeder, that cuts the sheets, sheet-by-sheet, to pre-determined widths depending on the position of the sheet in the booklet;

c) a sheet folder, connected to the trimmer, that folds the trimmed sheets, sheet-by-sheet;

d) a sheet stacker, connected to the folder, that collects the folded trimmed sheets, sheet-by-sheet, in a stack;

e) means, connected to the trimmer, folder, and stacker, for positioning the sheets, sheet-by-sheet, with respect thereto; and f) an ejector, connected to the sheet stacker, that removes the stacks of sheets from the apparatus.

16. The apparatus of claim 15 further including a paper aligner that aligns the sheets with respect to the trimmer, sheet-by-sheet, before the sheets are cut to pre-determined widths.

17. The apparatus of claim 15 wherein the sheet positioning means is a non-slip-wheel sheet positioner, connected to the trimmer, folder, and stacker, for positioning the sheets, sheet-by-sheet, with respect thereto so that the sheets are cut to various pre-determined widths and so that the sheets are all folded along a common fold line.

18. The apparatus of claim 15 further including a punch, connected to the trimmer, that cuts out a portion of the edge from a sheet at a predetermined position and depth, forming a notch.

19. The apparatus of claim 15 further including a punch, connected to the trimmer, that cuts out a portion of the edge from a sheet at a predetermined position and depth, forming a tab.

20. The apparatus of claim 15 further including a punch, connected to the trimmer, that punches a hole in a sheet.

21. The apparatus of claim 15 further including a stapler, connected to the stacker, that staples the stack of sheets together into a saddle stitched booklet.

22. The apparatus of claim 15 wherein the sheet folder folds the sheets along the centerline of each trimmed sheet.

23. A method for stacking sheets of printing media, comprising the steps of:

a) collecting the sheets in a stack on a workpiece, sheet-by-sheet, said sheets each having a fold therein;

b) registering the sheets in a stack on a workpiece, sheet-by-sheet, with the fold in each sheet;

c) unloading the stack of collected and registered sheets from the workpiece; and d) trimming the sheets, sheet-by-sheet, for booklets, each sheet having a width depending on the position of the sheet in the booklet.

24. A method for folding sheets of printing media, comprising the steps of:

a) positioning the sheets, sheet-by-sheet, in a media folder;

b) folding the sheets, sheet-by-sheet, in the media folder;

c) unloading the folded sheets, sheet-by-sheet, from the media folder; and d) trimming the sheets, sheet-by-sheet, in accordance with a pre-determined schedule.

25. A method for assembling sheets for booklets, each sheet having a position in the booklet, comprising the steps of:

a) trimming the sheets, sheet-by-sheet, with a cutter to a predetermined width depending on the position of the sheet in the booklet;

b) folding the trimmed sheets, sheet-by-sheet, in a media folder;

c) stacking the folded trimmed sheets in stacks along a common fold line in each sheet; and d) stapling the sheets together in the stack and forming a saddle stitched booklet thereby.

26. The method of claim 25 further including the step of feeding the sheets, sheet-by-sheet, into the cutter prior to the step of trimming.

27. The method of claim 25 further including the step of measuring the width of the sheets, sheet-by-sheet, prior to the step of trimming each sheet.

28. The method of claim 25 further including the step of measuring the thickness of the sheets, sheet-by-sheet, prior to the step of trimming each sheet.

29. The method of claim 25 wherein the step of folding includes the step of folding the sheets, sheet-by-sheet, along the centerline of each sheet after the step of trimming.

30. The method of claim 25 further including the step of capturing the sheets, sheet-by-sheet, in the media folder prior to the step of folding.

31. The method of claim 25 further including the step of capturing the sheets, sheet-by-sheet, in a bail prior to the step of trimming.

32. The method of claim 25 further including the step of punching a hole in selected sheets, sheet-by-sheet, after the step of trimming.

33. The method of claim 25 further including the step of punching a notch out of selected sheets, sheet-by-sheet, at a predetermined position and depth on the edge of the sheet after the step of trimming.

34. The method of claim 25 further including the step of multiply folding the sheets in the same direction as a first fold, sheet-by-sheet, at different locations.

35. The method of claim 25 further including the step of multiply folding the sheets in an opposite direction from a first fold, sheet-by-sheet, at different locations.

36. The method of claim 25 further including the step of displacing the images printed on the sheets, sheet-by-sheet, according to the width of each sheet after trimming so that the printed images are offset a prescribed distance from a fold line.

* * * * *